US006639874B2

(12) United States Patent
Shimizu et al.

(10) Patent No.: US 6,639,874 B2
(45) Date of Patent: Oct. 28, 2003

(54) POINTER ELECTRONIC TIMEPIECE, OPERATING METHOD AND CONTROL PROGRAM THEREOF

(75) Inventors: Eisaku Shimizu, Suwa (JP); Akihiko Maruyama, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/899,003

(22) Filed: Jul. 3, 2001

(65) Prior Publication Data

US 2002/0006080 A1 Jan. 17, 2002

(30) Foreign Application Priority Data

| | | |
|---|---|---|
| Jul. 4, 2000 | (JP) | 2000-202204 |
| Aug. 30, 2000 | (JP) | 2000-261086 |
| Jun. 7, 2001 | (JP) | 2001-172491 |
| Jun. 7, 2001 | (JP) | 2001-172492 |

(51) Int. Cl.[7] ..... G04C 21/00; G04C 23/00; G04F 8/00; G04B 29/00

(52) U.S. Cl. ..... 368/73; 368/71; 368/72; 368/74; 368/110; 368/319

(58) Field of Search ..... 368/71, 72–74, 368/319, 321, 80, 110, 113

(56) References Cited

U.S. PATENT DOCUMENTS

| | | | | | |
|---|---|---|---|---|---|
| 3,824,782 | A | * | 7/1974 | Iinuma | 368/185 |
| 4,223,523 | A | * | 9/1980 | Kamijo | 368/74 |
| 4,419,019 | A | * | 12/1983 | Nishimura et al. | 368/74 |
| 4,459,031 | A | * | 7/1984 | Perucchi | 368/69 |
| 4,623,261 | A | * | 11/1986 | Muto | 368/80 |
| 4,652,140 | A | * | 3/1987 | Nakazawa | 368/74 |
| 5,042,016 | A | * | 8/1991 | Suzuki et al. | 368/74 |
| 5,479,379 | A | * | 12/1995 | Tsuchiya et al. | 368/74 |
| 5,724,317 | A | * | 3/1998 | Kubota et al. | 368/11 |
| 5,881,025 | A | * | 3/1999 | Murakami | 368/74 |

FOREIGN PATENT DOCUMENTS

| | | | | | |
|---|---|---|---|---|---|
| JP | 354099472 | A | * | 8/1979 | 368/74 |
| JP | 357098889 | A | * | 6/1982 | 368/74 |
| JP | 58-99786 | | | 6/1983 | |
| JP | 360238782 | A | * | 11/1985 | 368/246 |
| JP | 405052967 | A | * | 3/1993 | 368/74 |

OTHER PUBLICATIONS

Abstract of Seiko Corporation Inspection/Adjustment Manual For Analog Caliber 8A Series, 1985.
Seiko Watch Catalogue 2001 vol. 2, p. 83.

* cited by examiner

*Primary Examiner*—David Martin
*Assistant Examiner*—Michael L. Lindinger
(74) *Attorney, Agent, or Firm*—Rosalio Haro

(57) ABSTRACT

A pointer electronic timepiece (1) has a plurality of step motors, a plurality of pointers (11 to 18), and a plurality of external operation members of a winding crown (5) and buttons (6, 7). The pointer to be adjusted is selected from the plurality of pointers (15 to 18) by operating one of the buttons (6) while drawing out the winding crown (5) to a second stage and the other button (7) is operated to adjust the position of the selected pointer. Since the position of the pointers (15 to 18) driven by three step motors can be adjusted by the two buttons (6, 7), the number of the external operation member is not necessary to be increased even when the pointers (15 to 18), i.e. the step motors, are increased, so that the size and thickness of a movement-holder and cost thereof can be reduced and operability during adjustment can be improved.

35 Claims, 12 Drawing Sheets

FIG. 8

| WINDING CROWN | SWITCH INPUT | SWITCH FUNCTION | RM ROTATION FUNCTION |
|---|---|---|---|
| ZERO-STAGE (RM0) | SWA | CHRONOGRAPH START, STOP | FREE |
| | SWB | CHRONOGRAPH RESET<br>SPLIT, CANCELING SPLIT | |
| FIRST STAGE (RM1) | SWA | NO EFFECT | RIGHT ROTATION: DATE ADJUSTMENT<br>LEFT ROTATION: FREE |
| | SWB | ·ALARM TIME SETTING<br>·CONTINUOUS PRESSING (RAPID-FEEDING)<br>·CANCELING ALARM SETTING WHEN COINCIDING WITH CURRENT TIME | |
| SECOND STAGE (RM2) | PUSH SWB FOR ALARM CURRENT-TIME ADJUSTING (ACCELERATED RAPID-FEEDING) | | POINTER ADJUSTMENT (PRIMARY TIME ADJUSTMENT) |
| | PUSH SWA (FOR ONE TO TWO SECONDS) TO MINUTE CG ZERO-POSITION ADJUSTING MODE MINUTE CG ROTATES ONCEPUSH SWB TO ADJUST ZERO-POSITION OF MINUTE CG | | |
| | PUSH SWA (FOR ONE TO TWO SECONDS) TO MINUTE CG ZERO-POSITION ADJUSTING MODE ONE-FIFTH CG ROTATES ONCE PUSH SWB TO ADJUST ZERO-POSITION OF MINUTE CG | | |
| | PUSH SWA (FOR ONE TO TWO SECONDS) TO RETURN TO ALARM CURRENT-TIME ADJUSTING MODE AGAIN THE HOUR ALARM HAND ROTATES ONCE (MINUTE ALARM HAND ROTATES FOR TWELVE TIMES) | | |

POINTER ELECTRONIC TIMEPIECE, OPERATING METHOD AND CONTROL PROGRAM THEREOF

BACKGROUND OF THE INVENTION

1. Field of the Invention

The present invention relates to a pointer electronic timepiece, an operating method of the pointer electronic timepiece and a control program of the pointer electronic timepiece. Specifically, it relates to a pointer electronic timepiece having a pointer other than ordinary time-indicating pointer such as chronograph pointer and alarm pointer.

2. Description of Related Art

Recently, various functions such as chronograph, alarm and timer are required not only for digital electronic timepiece but also for pointer electronic timepiece (analog electronic timepiece), so that various multi-function pointer electronic timepieces have been commercialized.

Such pointer electronic timepiece has a pointer for chronograph count indication, an alarm time setting pointer and a pointer for indicating measured count value when various sensors such as altimeter are installed provided on a dedicated small window on a dial, in addition to time-indicating pointers (pointer of primary timepiece) such as hour hand, minute hand and second hand.

The respective pointers are ordinarily driven by independent step motors. For instance, when chronograph pointers, e.g. one-fifth chronograph hand (one-fifth second CG hand) and a minute chronograph hand (minute CG hand), are provided as well as time-indicating step motor, two step motors for driving respective pointers are separately provided. Further, when an alarm pointer is provided, a step motor for driving the pointer is separately provided. In the same manner, when a sensor such as an altimeter is provided, a step motor for driving the pointer is separately provided.

Among the pointers, the hour-indicating pointer is ordinarily adjusted by drawing out a winding crown to a pointer-adjusting position and rotating the winding crown.

On the other hand, position adjustment of the CG hands, alarm pointer, and sensor pointer becomes necessary in order to set initial value. Specifically, though the respective CG hands etc. return to zero-position thereof by resetting operation, the position returned by resetting may be shifted from the predetermined zero-position when the device is initialized by battery exchange etc.

In order to correct the position shift, a button is provided for every pointer driven by the respective step motors and the button corresponding to the pointer to be adjusted are operated to correct the position shift. For instance, when three step motors for respectively driving the one-fifth second CG hand, minute CG hand and alarm hand are provided as well as the ordinary time-indicating step motor, three switches (buttons) are provided as well as the winding crown and the initial position of the pointers driven by the respective step motors are corrected by operating the switches.

However, when the switches are provided for every pointer, the number of the switches is increased to prevent reduction of size and thickness reduction of the movement-holder becomes difficult and production cost increases.

Further, when the number of switches is increased, it is difficult to identify the switch corresponding to the pointer to be adjusted, thereby deteriorating operability thereof.

On the other hand, a timepiece having an alarm pointer for alarming function as well as the primary timepiece pointers has, as shown in Japanese Patent Publication No. Hei 7-104418 and publication of Japanese Patent No. 2998749, a second winding crown (winding-shaft) and a switch for operating the alarm pointer as well as a winding crown for adjusting the pi timepiece pointers.

However, when the number of the external operation member increases, the space for the operation member and switching mechanism has to be set wide, so that reduction in size and thickness of the movement-holder becomes difficult and component layout becomes restricted to make design difficult. Further, since more number of parts is required, production cost thereof can be increased.

An object of the present invention is, in a pointer electronic timepiece having alarm function, to eliminate the need for increasing the external operation member such as a winding crown, to reduce size and thickness of the movement-holder and to enhance layout freedom, thus restraining increase in cost.

Another object of the present invention is, in a pointer electronic timepiece, even when the number of the pointer is increased, to eliminate the need for increasing the number of external operation member such as a switch and to facilitate an adjusting operation.

SUMMARY OF THE INVENTION

In order to improve alarm function, the present invention uses following arrangement.

A pointer electronic timepiece according to an aspect of the present invention has: a plurality of step motors; a plurality of pointers driven by the step motors, the plurality of pointers at least including a primary timepiece pointer for indicating current time and an alarm pointer for indicating an alarm setting time; a plurality of external operation members; a current time counter for counting the current time; an alarm counter for storing the alarm setting time; an alarm beeper; and an alarm controller for controlling the alarm pointer and the alarm beeper; the external operation member including a winding crown for operating the primary timepiece pointer, the winding crown being capable of changing position thereof to at least three positions including a zero stage, a first stage and a second stage, the alarm controller switching an alarm beeping mode assigned with the alarm setting time for beeping the alarm when the current time coincides with the alarm setting time, an alarm time setting mode for setting the alarm setting time, and an alarm current time adjusting mode for adjusting the alarm pointer with the current time corresponding to the three positions of the winding crown.

According to the above arrangement, since the respective control modes of the alarm controller for operating the alarm pointers and alarm setting are switched by the winding crown for operating the primary timepiece pointers, conventional second winding crown is not necessary. Accordingly, the number of external operation member can be reduced, thereby reducing size and thickness of the movement holder, enhancing freedom in layout and reducing production cost. Especially, since the winding crown requires wider space than the other external operation member such as a switch because switching mechanism are attached, the size and thickness reduction of the movement holder can be further efficiently conducted by reducing the number of the winding crown as compared to reduction in the switch.

In the above arrangement, the zero stage of the winding crown may preferably be a position for ordinary driving, the first stage is a position for date adjustment of the primary timepiece pointer and the second stage is a position for pointer adjustment of the primary timepiece pointer, and the alarm controller may preferably be set to the alarm beeping mode when the winding crown is positioned at the zero stage, to the alarm time setting mode when the winding crown is positioned at the first stage and to the alarm current time adjusting mode when the winding crown is positioned at the second stage.

According to such arrangement, since the frequently used alarm time setting operation is conducted when the winding crown is drawn out to the first stage and the less frequent alarm current time adjusting operation is conducted when the winding crown is drawn out to the second stage, overall operability of the alarm operation can be improved.

In the pointer electronic timepiece according to the present invention, the external operation member ay preferably include at least one switch in addition to the winding crown, and, when the alarm controller is switched to the respective modes in accordance with the position of the winding crown, the alarm controller may preferably be operated in the respective modes by operating the switch.

More specifically, the alarm controller may preferably include: a winding crown position detector for detecting the position of the winding crown; a switch detector for detecting the condition of the at least one switch; and an alarm control portion for executing the operation in the respective modes based on a winding crown position information detected by the winding crown position detector and a switch condition information detected by the switch detector.

The number of the switch may be one when only the alarm function is added. However, when the timepiece has the other functions such as chronograph, two switches may preferably be provided.

Incidentally, when the switching operation in the alarm control mode is conducted by the winding crown for operating the primary timepiece pointer, the operation in the respective alarm control mode has to be distinguished from the operation of the primary timepiece etc (calendar correction and pointer adjustment of primary timepiece etc). One solution thereof is to set an operation within a predetermined time after the winding crown is moved to a predetermined step as an operation for the primary timepiece etc. and other operations after the predetermined time elapsed as an operation in the alarm control mode.

On the other hand, by providing a switch as well as the winding crown, calendar collection and pointer adjustment of primary timepiece can be conducted when the winding crown itself is rotated after moving the winding crown to a predetermined stage, and, when the operation such as pressing the switch is conducted, pointer adjustment of the alarm pointers and alarm time setting can be conducted. Accordingly, the user of the timepiece can clearly distinguish the operation in the respective alarm control mode and the operation of the primary timepiece, thereby improving operability as compared to time-distinction.

In the pointer electronic timepiece according to the present invention, the alarm controller may preferably include an alarm pointer drive controller for controlling the alarm pointer to be stopped indicating the alarm setting time in the alarm-set condition with the alarm setting time being set and to be driven in the alarm-non-set condition not in the alarm-set condition.

The pointer-drive during alarm-non-set condition may be a pointer-drive for world-time function with a time lag relative to the current time. However, the alarm pointer may preferably be driven to indicate the same time as the primary timepiece.

Specifically, the alarm pointer drive controller can control the drive of the alarm pointer so that the same time as the primary timepiece is indicated during the alarm-non-set condition.

According to the above arrangement, the user can easily recognize whether the alarm-set condition is set or not by judging whether the alarm pointer coincides with the primary timepiece or is normally driven. Especially, when the alarm pointer indicates the same time as the primary timepiece during the alarm-non-set condition, whether the alarm-set condition is established or not can be further easily recognized.

In the pointer electronic timepiece according to the present invention, the alarm controller may preferably have an alarm executor for letting the alarm beeper to beep an alarm and switching to the alarm-non-set condition when the alarm counter and the current time counter coincide in the alarm beeping mode and in the alarm-set condition having the alarm setting time being set.

According to the above arrangement, one-touch alarm function capable of beeping the alarm when the alarm time has been reached can be easily implemented.

In the pointer electronic timepiece according to the present invention, the alarm controller may preferably have an alarm switch for setting the alarm-set condition in the alarm time setting mode when the alarm setting time and the current time do not coincide and for setting the alarm-non-set condition in the alarm time setting mode when the alarm setting time and the current time coincide with each other.

Accordingly, the alarm-set and alarm-non-set conditions are not necessary to be set by operating the other switches, thereby restraining increase in the external operation member.

In the pointer electronic timepiece according to the present invention, the alarm controller may preferably have a rapid-feeder for switching a feed motion of the alarm pointer to a rapid-feed motion by a predetermined operation, the rapid-feeder suspending the rapid-feed motion of the alarm pointer by the rapid-feeder in the alarm-time setting mode and when the alarm setting time and the current time coincide with each other while rapidly feeding the alarm pointer.

According to the above arrangement, since the rapid-feeding is automatically suspended when the alarm setting time and the current time coincide only by rapid-feed operation of the alarm pointer to bring the alarm setting time and the current time into consistency in order to cancel the alarm setting, the alarm setting time and the current time can be easily brought into consistency and operability in switching to the alarm-non-set condition can be improved.

An operation method according to another aspect of the present invention is for a pointer electronic timepiece, the pointer electronic timepiece comprising: a plurality of step motors; a plurality of pointers including at least a primary timepiece pointer for indicating a current time and an alarm pointer for indicating an alarm setting time, the plurality of pointers being driven by the step motors; a current time counter for counting the current time; an alarm counter for storing the alarm setting time; an alarm beeper; an alarm controller for controlling the alarm pointer and the alarm beeper; and an external operation member, the method including the steps of; providing as the external operation member a winding crown capable of operating the primary timepiece pointer and changing position thereof to at least three positions including a zero stage, a first stage and a second stage; and switching an alarm beeping mode for beeping an alarm when the alarm setting time is set and when the current time coincides with the alarm setting time, an alarm time setting mode for setting the alarm setting time and an alarm current time adjusting mode for adjusting the alarm pointer with the current time corresponding to the three positions of the winding crown.

According to the above method, since the operation of the alarm pointer and switching between the respective control mode of the alarm controller are conducted by the winding crown for operating the primary timepiece pointer, conventional second winding crown is not necessary to be provided to the pointer electronic timepiece. Accordingly, even in the pointer electronic timepiece having alarm pointers, the number of external operation member can be reduced, so that the size and thickness of the movement holder can be reduced, layout freedom can be improved and production cost can be reduced. Especially, since the winding crown having switching mechanism requires larger space than the other external operation member such as a switch, the size and thickness of the movement-holder can be more efficiently reduced by reducing the number of the winding crown than reducing switches.

In the operation method according to the present invention, the alarm pointer may preferably be stopped while indicating the alarm setting time during the alarm-set condition having set with the alarm setting time, and the alarm pointer may preferably be driven in a predetermined manner during the alarm-non-set condition not in the alarm-set condition.

Accordingly, the user can easily recognize whether the alarm-set condition is set or not by judging whether the alarm pointer coincides with the primary timepiece or is normally driven. Especially, when the alarm pointer indicates the same time as the primary timepiece during the alarm-non-set condition, whether the alarm-set condition is established or not can be further easily recognized.

In the operation method of the present invention, when the alarm counter and the current time counter are consistent during the alarm beep mode and in alarm-set condition having set with the alarm setting time, the alarm beeper may preferably beep the alarm and the alarm-non-set condition may preferably be set.

According to the above arrangement, one-touch alarm function for beeping the alarm once when the alarm time comes can be easily achieved.

In the operating method of the present invention, the alarm-set condition may preferably be set in the alarm time setting mode when the alarm setting time and the current time do not coincide, and the alarm-non-set condition may preferably be set in the alarm time setting mode when the alarm setting time and the current time coincide with each other.

Accordingly, there is no need for operating the other switch for setting and canceling the alarm, thereby restraining increase in the external operation member.

In the operation method of the present invention, a feeding motion of the alarm pointer may preferably be switched to a rapid-feeding motion by a predetermined operation, and the rapid feeding motion of the alarm pointer may preferably be stopped when the alarm setting time and the current time coincide in the alarm time setting mode and while rapidly feeding the alarm pointer.

Accordingly, since the rapid-feed is automatically suspended when the alarm setting time and the current time coincide only by rapid-feed operation of the alarm pointer to bring the alarm setting time and the current time into consistency in order to cancel the alarm setting, the alarm setting time and the current time can be easily brought into consistency and operability for canceling the alarm setting can be improved.

A control program according to the present invention is a control program installed to a pointer electronic timepiece, the pointer electronic timepiece comprising: a plurality of step motors; a plurality of pointers at least including a primary timepiece pointer for indicating a current time and an alarm pointer for indicating an alarm setting time, the plurality of pointers being driven by the step motors; a current time counter for counting the current time; an alarm counter for storing the alarm setting time; an alarm beeper; an alarm controller for controlling the alarm pointer and the alarm beeper; and an external operation member including a winding crown capable of operating the primary timepiece pointer and changing position thereof to at least three positions of a zero stage, a first stage and a second stage, the control program executing a step for switching an alarm beeping mode for beeping an alarm when the alarm setting time is set and when the current time is consistent with the alarm setting time, an alarm time setting mode for setting the alarm setting time and an alarm current time adjusting mode for adjusting the alarm pointer with the current time corresponding to the three positions of the winding crown.

According to the control program, since the respective control modes of the alarm controller for operating the alarm pointers and alarm setting are switched by the winding crown for operating the primary timepiece pointers, conventional second winding crown is not necessary. Accordingly, the number of external operation member can be reduced, thereby reducing size and thickness of the movement holder, enhancing freedom in layout and reducing production cost. Especially, since the winding crown requires wider space than the other external operation member such as a switch because switching mechanism are attached, the size and thickness reduction of the movement holder can be further efficiently conducted by reducing the number of the winding crown as compared to reduction in the switch.

In the control program of the present invention, a step of suspending the alarm pointer while indicating the alarm setting time during the alarm-set condition having set with the alarm setting time, and the step of ordinarily driving the alarm pointer during the alarm-non-set condition not in the alarm-set condition may preferably be executed.

According to the arrangement, the user can easily recognize whether the alarm-set condition is set or not by judging whether the alarm pointer coincides with the primary timepiece or is normally driven. Especially, when the alarm pointer indicates the same time as the primary timepiece during the alarm-non-set condition, whether the alarm-set condition is established or not can be further easily recognized.

The control program according to the present invention, during the alarm beep mode and alarm-set condition having set with the alarm setting time when the alarm counter and the current tine counter are consistent, a step of letting the alarm beeper to beep the alarm and to be set to the alarm-non-set condition may preferably be executed.

According to the above arrangement, one-touch alarm function capable of beeping the alarm when the alarm-time has been reached can be easily implemented.

The control program according to the present invention, steps of setting the alarm-set condition in the alarm time setting mode when the alarm setting time and the current time do not coincide, and setting the alarm-non-set condition in the alarm time setting mode when the alarm setting time and the current time coincide may preferably be executed.

Accordingly, alarm-set and alarm-non-set conditions are not required to be set by operating the other switches, thereby restraining increase in the external operation member.

In the control program according to the present invention, steps of switching a feeding motion of the alarm pointer to a rapid-feeding motion by a predetermined operation, and stopping the rapid feeding motion of the alarm pointer when the alarm setting time and the current time coincide while rapidly feeding the alarm pointer in the alarm time setting mode may preferably be executed, According to still another aspect of the present invention, following arrangement can be executed in order to cope with increase in the number of pointers in addition to the above-described alarm function.

A pointer electronic timepiece according to the present invention has a plurality of step motors, a plurality of external operation members and the above-described alarm function, the pointer electronic timepiece further includes; a pointer selector for selecting the pointer to be adjusted from the plurality of pointers by operating any one of the external operation members among the external operation members; and a pointer position adjuster for adjusting a position of the selected pointer by operating the other one of external operation members.

According to the present invention, since the pointer to be corrected is selected by either one of the external operation members and the position of the selected pointer is adjusted by the other external operation member, the position of the pointers can be adjusted by at least two external operation members irrespective of the number of the pointers. Accordingly, the number of the external operation member is not necessary to be increased even when the pointers are increased, thereby reducing size, thickness and production cost of the movement holder.

Further, since the position of the pointers can be adjusted by operating the two external operation members and the function of the external operation members are determined in such a manner that one of the external operation member selects the pointer and the other adjusts the selected pointer, operability thereof can be improved.

In the above arrangement, the number of the step motor may preferably be more than the number of the external operation member. In the present invention, a timepiece having, for instance, only two step motors may be used where an external operation member for driving the object to be adjusted, i.e. the step motor for driving the pointer, and another external operation member for adjusting the position of the pointer may be provided, thus equaling the number of the step motor and the external operation member. However, when the number of the step motors is more than the external operation member, CG hands, alarm pointers and a pointer for indicating measured value of a sensor such as an altimeter can be installed therein, thus obtaining a multi-function timepiece. Incidentally, when the winding crown is used as the external operation member and when the selection of step motors and the position adjustment of the pointers are conducted by the external operation member other than the winding crown such as a button, the number of step motors may preferably be more than the external operation member other than the winding crown.

In the pointer electronic timepiece according to the present invention, the pointer selector may preferably set any one of the external operation members except for the winding crown in a selection mode for selecting the pointer to be adjusted when the winding crown is drawn out to a predetermined first position, and the pointer position adjuster may preferably set the other one of external operation members except for the winding crown in a position adjusting mode for adjusting the position of the selected pointer when the winding crown is drawn out to the predetermined first position.

After drawing out the winding crown to the predetermined draw-out position, the pointer can be selected and the position can be adjusted by operating only the external operation member, thereby improving operability. Further, the other functions can be set to the external operation member when the winding crown is set to the other draw-out position, so that more functions can be given. Further, since the pointer selection and pointer adjustment functions work only when the winding crown is explicitly moved, mistaken operation can be reduced, thereby conducting an operation easy for the user to understand.

In the above arrangement, the predetermined first position for the winding crown to be drawn out may preferably be a position for adjusting a time of the primary timepiece pointer when the winding crown is rotated.

Accordingly, when the winding crown is rotated after drawing out the winding crown to the predetermined draw-out position, the time of the primary timepiece can be adjusted, and when the external operation member is operated, the position of the other pointers can be adjusted. Therefore, the draw-out position of the winding crow for position adjusting operation of the pointer can be made single, so that the user can easily memorize the position. Accordingly, operability of less frequent operation of pointer adjustment can be improved.

In the pointer electronic timepiece according to the present invention, a selected object indicator for letting the selected pointer to be adjusted by operating the external operation member to conduct a predetermined movement to indicate the selected object may preferably be provided.

The predetermined movement by the selected object indicator may preferably be a movement of the selected pointer from the current position to return to the current position. Especially, the selected object indicator may preferably rotate the pointer at least once.

The selected pointer can be easily recognized by the predetermined movement of the pointer to be adjusted such as rotation of the pointer and back and forth movement at a predetermined angle, so that the adjustment operation can be easily conducted. At this time, by returning the moved pointer to the current position, pointer other than the adjusted pointer can return to the original position thereof, so that which one of the pointers is adjusted can be easily recognized, thereby improving operability.

Further, by the one-rotation movement of the pointer, the selected pointer can be easily recognized and drive control thereof can be facilitated since it is only necessary to input a signal for rotating the pointer once in order to drive the pointer.

The pointer may be rotated more than once for indicating the selected object. However, though eminent indication is possible by increasing the number of rotation, since the movement time can be lengthened, next work may have to be waited. Accordingly, one or two rotations are preferable.

In the above arrangement, a first counter for counting an input pulse of a predetermined time standard signal corresponding to the counters; a second counter provided corresponding to the first counter; a coincidence circuit for detecting whether the counter values coincide with each other or not; and a signal generator for outputting a pulse signal corresponding to a difference of the counter value to drive the step motor and for inputting the pulse signal to the second counter, the selected object indicator rotating the pointer at least once by inputting at least one pulse to the second counter when the pointers are selected may preferably be provided.

According to the above arrangement, only one pulse of signal may be inputted to the second counter in order to rotate the selected pointer once, so that very simple structure is possible. A plurality of pulses may be inputted, though one pulse input is sufficient for one rotation. When the pointer is rotated for a plurality of times, the next pulse is inputted after completion of the previous rotation.

In the pointer electronic timepiece according to the present invention, the winding crown may preferably be drawn out to a plurality of predetermined positions, and the pointer selector may preferably include: a standard selector for selecting a first pointer to be adjusted when the winding crown is drawn out to a predetermined position; and a selection switch for sequentially selecting the other pointer to be adjusted when any one of the external operation members except for the winding crown is operated while the winding crown is drawn out to the predetermined position.

The selecting operation of the pointer can be lessened by the arrangement of selecting the first pointer to be adjusted only by drawing out the winding crown to the predetermined position. Especially, when the first object to be adjusted is the frequently adjusted alarm pointer, operability in adjusting operation can be improved.

In the pointer electronic timepiece according to the present invention, the winding crown may preferably be capable of being drawn out to a plurality of predetermined positions, and the pointer selector may preferably have a selection switch for sequentially selecting the other pointer to be adjusted when any one of the external operation members except for the winding crown is operated while the winding crown is drawn out to the predetermined position.

According to the above arrangement, since the operation of selecting the pointer to be adjusted by the first external member and the position adjustment of the selected pointer by the second external member is common, the user can easily grasp the adjusting operation.

The plurality of pointers may preferably include an alarm pointer and a chronograph pointer, and the pointer selector may preferably initially select the alarm pointer in selecting the pointer to be adjusted from the pointers.

The position of the chronograph pointer is adjusted only when the reset position thereof is shifted such as battery exchange, which is not so frequent. On the other hand, since the alarm pointers are independent of the ordinary time-indicating pointers, functions other than the alarm function such as world-time function having a time lag relative to the current time can be given thereto. Accordingly, when the position adjusting operation of the alarm pointer to the current time is conducted by the external operation members, the adjusting operation of the alarm pointer is more frequent than the adjusting operation of the CG hands. Therefore, by initially selecting the alarm pointer as the object to be adjusted when the winding crown is drawn out, the efficiency of adjusting operation can be enhanced.

An operation method according to the present invention is an operation method of a pointer electronic timepiece having a plurality of step motors, a plurality of pointers driven by the step motors and the above-described alarm function, in which the pointer to be adjusted is selected from the plurality of pointers by operating any one of the external operation members, and the position of the selected pointer is adjusted by operating the other one of the external operation members.

In the present invention, since the pointer to be adjusted is selected by either one of the external member and the other one of external members adjusts the position of the selected pointer, the position of the respective pointers can be adjusted by at least two external operation member irrespective of the number of the pointers. Accordingly, the number of the external member is not necessary to be increased, thereby reducing size, thickness and cost of the movement holder.

Further, since the position of the pointers can be adjusted by operating the two external operation members and the function of the external operation members are determined in such a manner that one of the external operation member selects the pointer and the other adjusts the selected pointer, operability thereof can be improved.

In the operation method according to the present invention, the pointer to be adjusted may preferably be selected by any one of the external operation members except for the winding crown when the winding crown is drawn out to a predetermined first position, and the position of the selected pointer may preferably be adjusted by operating the other one of the external operation members except for the winding crown.

After drawing out the winding crown to the predetermined draw-out position, the pointer can be selected and the position can be adjusted by operating only the external operation member, thereby improving operability. Further, the other functions can be set to the external operation member when the winding crown is set to the other draw-out position, so that more functions can be given. Further, since the pointer selection and pointer adjustment functions work only when the winding crown is explicitly moved, mistaken operation can be reduced, thereby conducting an operation easy for the user to understand.

In the operation method of the present invention, a predetermined movement may preferably be conducted by the pointer to be adjusted selected by operating the external operation member to indicate the selected object.

The selected pointer can be easily recognized by the predetermined movement of the pointer to be adjusted such as rotation of the pointer and back and forth movement at a predetermined angle, so that the adjustment operation can be easily conducted. At this time, by returning the moved pointer to the current position, pointer other than the adjusted pointer can return to the original position thereof, so that which one of the pointers is adjusted can be easily recognized, thereby improving operability.

A control program according to the present invention is a control program to be installed in a pointer electronic timepiece having a plurality of step motors, a plurality of pointers driven by the step motors and the above-described alarm function for adjusting the pointers, the program executing the steps of selecting the pointer to be adjusted from the plurality of pointers by operating any one of the extend operation members, and adjusting the position of the selected pointer by operating the other one of the external operation members.

According to the present invention, since the pointer to be corrected is selected by either one of the external operation members and the position of the selected pointer is adjusted by the other external operation member, the position of the pointers can be adjusted by at least two external operation members irrespective of the number of the pointers. Accordingly, the number of the external operation member is not necessary to be increased even when the pointers are increased, thereby reducing size, thickness and production cost of the movement holder.

Further, since the position of the pointers can be adjusted by operating the two external operation members and the function of the external operation members are determined in such a manner that one of the external operation member selects the pointer and the other adjusts the selected pointer, operability thereof can be improved.

Further, the above-described adjusting function can be provided as software, alteration in function is easy and action revision can be easily conducted to a timepiece already distributed to the market by re-installation of program.

In the control program of the present invention, the pointer electronic timepiece may preferably include a winding crown capable of being drawn out to a predetermined plurality of positions as at least one of the external operation member, and the program may preferably execute the steps of selecting the pointer to be adjusted by any one of the external operation members except for the winding crown when the winding crown is drawn out to a predetermined first position, and adjusting the position of the selected pointer by operating the other one of the external operation members when the winding crown is drawn out to the predetermined first position.

After drawing out the winding crown to the predetermined draw-out position, the pointer can be selected and the position can be adjusted by operating only the external operation member, thereby improving operability. Further, the other functions can be set to the external operation member when the winding crown is set to the other draw-out position, so that more functions can be given. Further, since the pointer selection and pointer adjustment functions work only when the winding crown is explicitly moved, mistaken operation can be reduced, thereby conducting an operation easy for the user to understand.

In the control program of the present invention, the step of conducting a predetermined movement by the pointer to be adjusted selected by operating the external operation member to indicate the selected object may preferably be executed.

The selected pointer can be easily recognized by the predetermined movement of the pointer to be adjusted such as rotation of the pointer and back and forth movement at a predetermined angle, so that the adjustment operation can be easily conducted. At this time, by returning the moved pointer to the current position, pointer other than the adjusted pointer can return to the original position thereof, so that which one of the pointers is adjusted can be easily recognized, thereby improving operability.

BRIEF DESCRIPTION OF THE DRAWINGS

FIG. 8 is an illustration showing an operating method of a function of the pointer electronic timepiece of the aforesaid embodiment;

DETAILED DESCRIPTION OF PREFERRED EMBODIMENT(S)

An embodiment of the present invention will be described below with reference to attached drawings.

Figure 1:
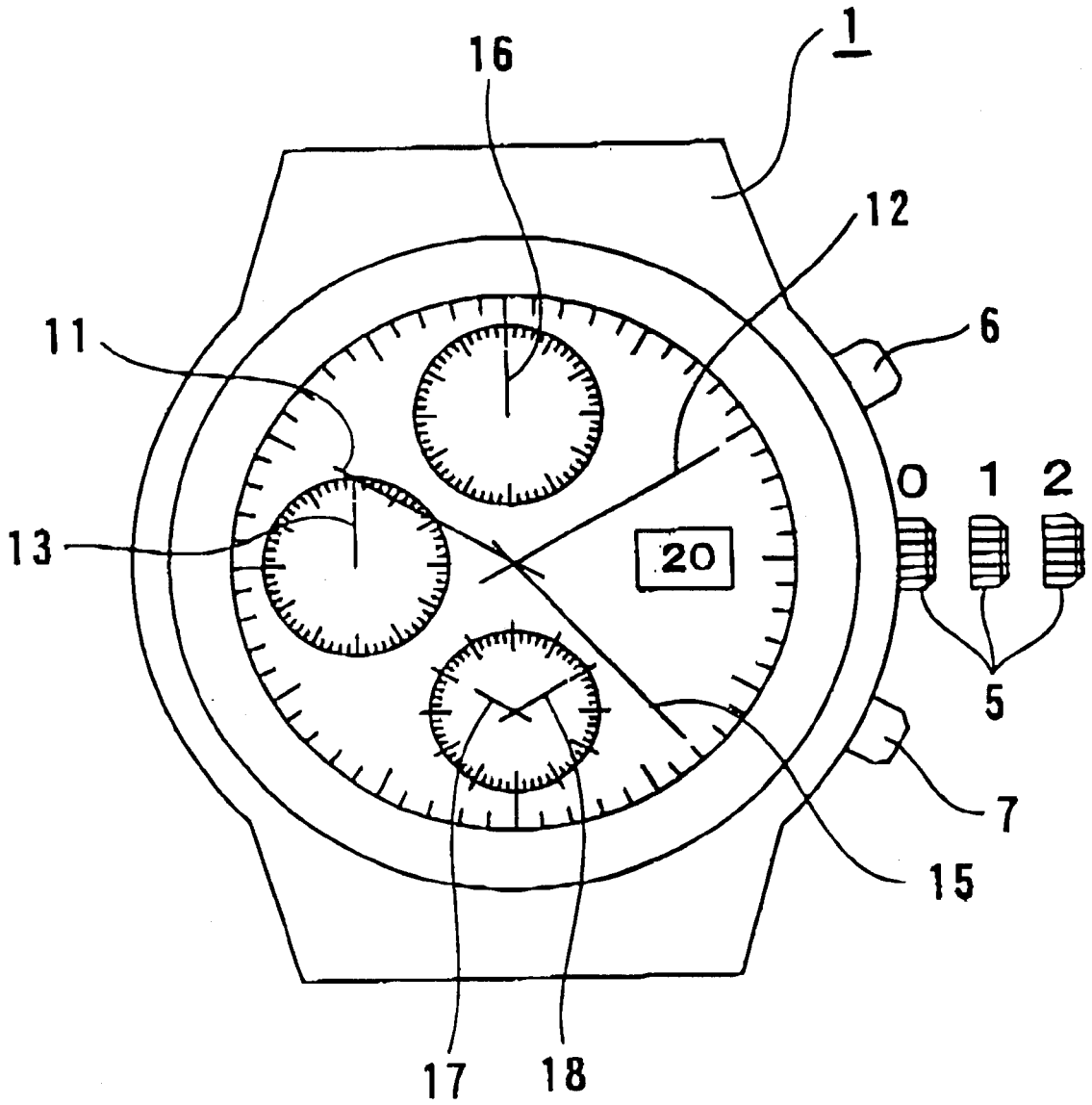
FIG. 1 is a front elevation showing a dial portion of a pointer electronic timepiece according to an embodiment of the present invention.

As shown in FIG. 1, a pointer electronic timepiece 1 has an hour hand 11, a minute hand 12 and a small second hand 13 for ordinarily displaying time. The small second hand 13 is located at a position shifted counterclockwise (approximately nine-o'clock position) relative to central axis of the dial.

The pointer electronic timepiece 1 also has a one-fifth second CG hand (one-fifth second chronograph hand) 15 coaxial with the hour hand 11 and the minute hand 12 for indicating chronograph second for every one-fifth second, and a minute CG hand (minute chronograph hand) 16 located approximately at twelve o'clock position relative to the central axis of the timepiece 1 for indicating chronograph minute for every one minute. An alarm hour hand 17 and an alarm minute hand 18 located at six o'clock position relative to the central axis of the timepiece 1 are also provided to the timepiece 1.

A winding crown 5 as an external operation member and an A button (switch A, SWA) 6 and a B button (switch B, SWB) also as external operation member are provided to the pointer electronic timepiece 1. An alarm 19 using sound such as an electronic buzzer is installed in the pointer electronic timepiece 1.

Figure 2:
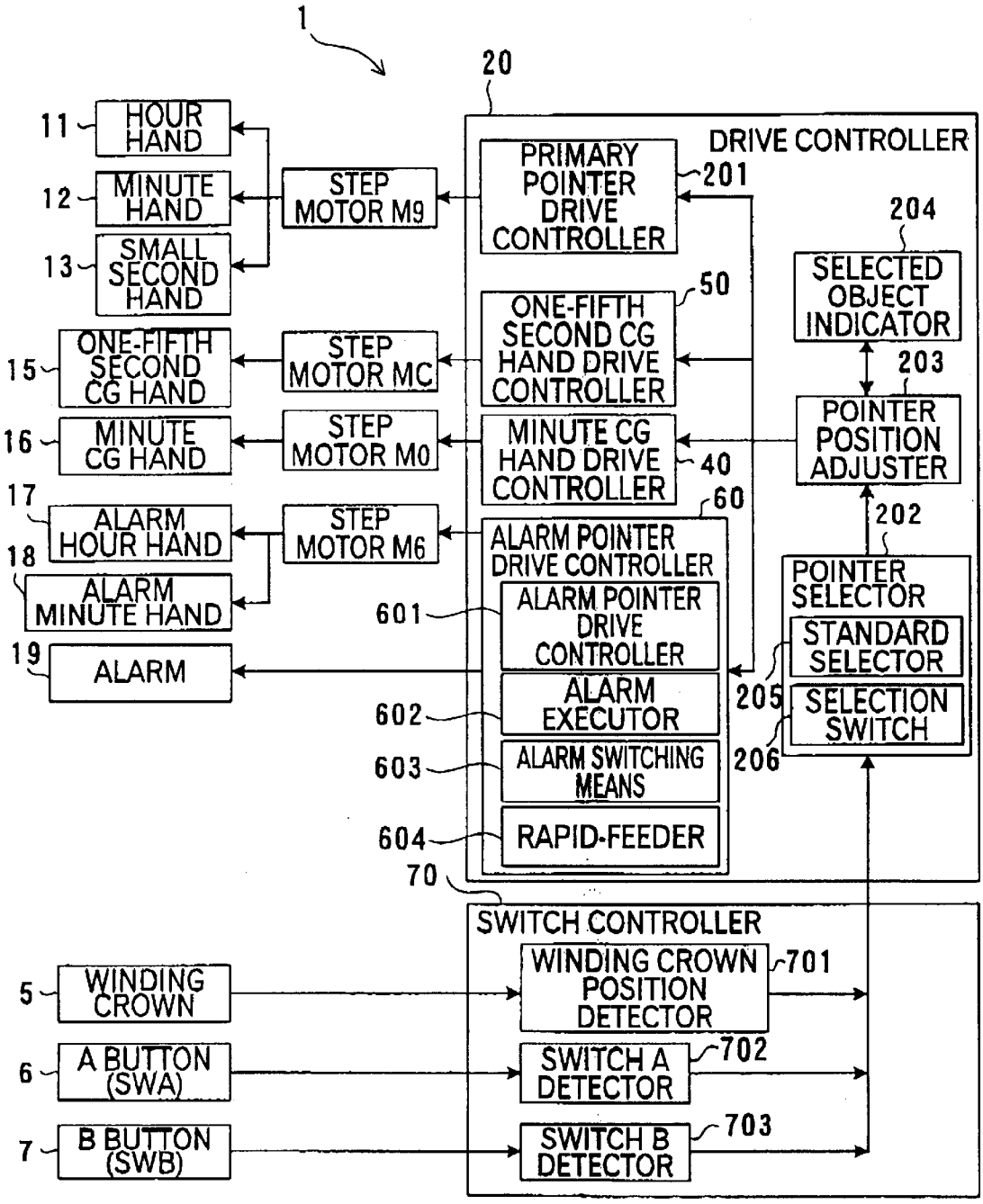
FIG. 2 is a block diagram showing a control system of the pointer electronic timepiece of the aforesaid embodiment.

As shown in FIG. 2, the respective pointers 11 to 13, and 15 to 18 are driven by four step motors. Specifically, the hour hand 11, the minute hand 12, the small second hand 13 are driven by a step motor M9, the minute CG hand 16 is driven by a step motor M0, the one-fifth second CG hand 15 is driven by a step motor MC and the alarm second hand 18 and the alarm hour hand 17 interlocking with the alarm second hand 18 are driven by a step motor M6.

Figure 3:
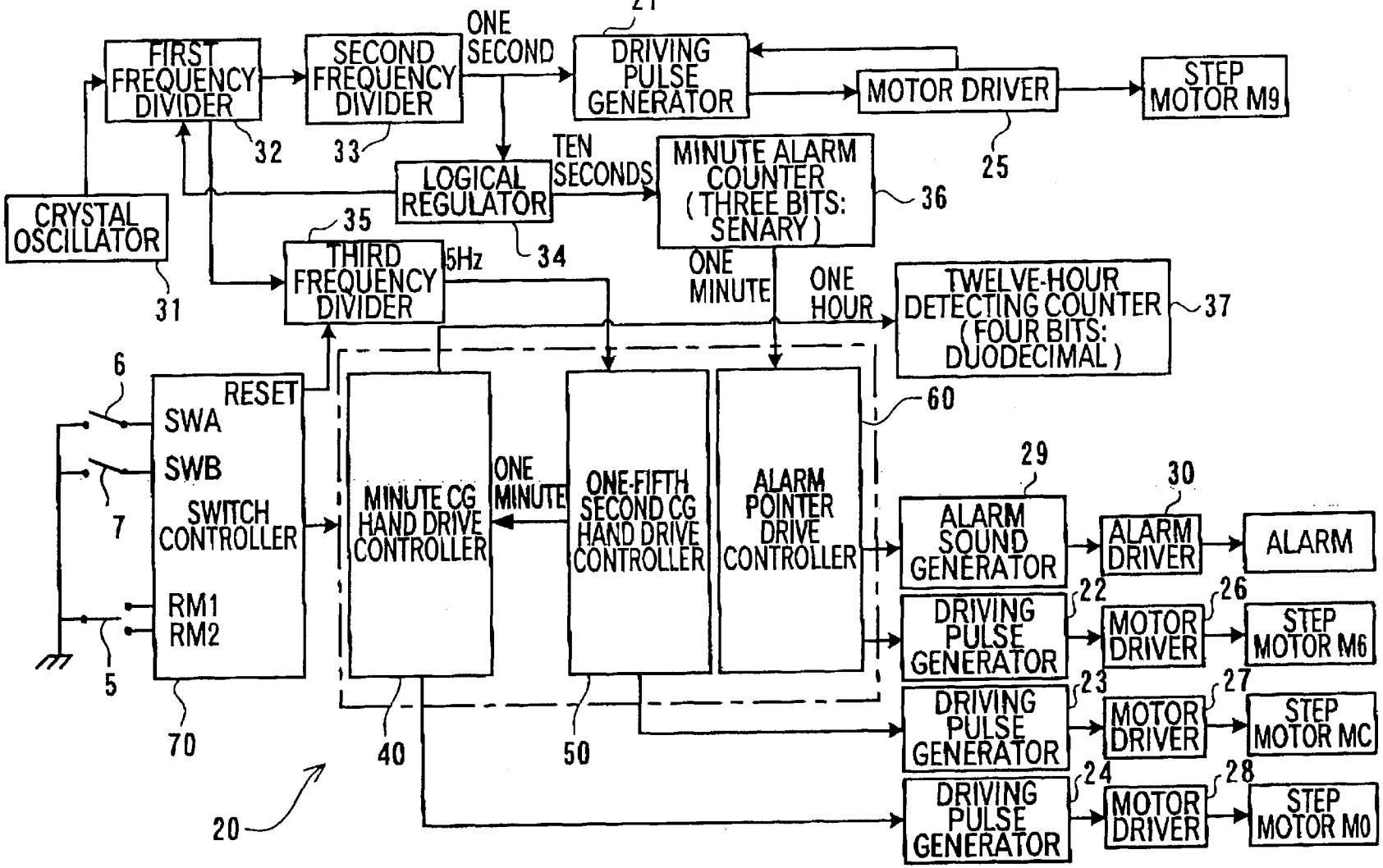
FIG. 3 is a block diagram showing an arrangement of a drive controller of the aforesaid embodiment.

The respective step motors are driven through respective motor drivers 25 to 28 by inputting a predetermined pulse signal into drive pulse generators 21 to 24 (see FIG. 3).

Detailed arrangement of the drive mechanism (gear train etc.) for driving the respective pointers 11 to 18 by the respective step motors are the same as the conventional art disclosed in Japanese Patent Publication No. 2998749 and is omitted.

In order to control the drive of the respective step motors, a drive controller 20 is installed in the pointer electronic timepiece 1.

The drive controller 20 ordinarily drives the respective step motors based on drive signals from a crystal oscillator 31 (see FIG. 3, described below in detail) and includes a primary pointer drive controller 201 for controlling drive of the hour hand 11, the minute hand 12, and the small second hand 13 through the step motor M9, a minute CG hand drive controller 40 for driving the minute CG hand 16 through the step motor M0, and a one-fifth second CG hand drive controller 50 for driving the one-fifth second CG hand 15 through the step motor MC.

The drive controller 20 also works as an alarm controller and includes an alarm pointer drive controller 60 as an alarm controller, which conducts alarm setting such as adjustment of the alarm hour hand 17 and the alarm minute hand 18 as alarm pointers through the step motor M6 and controllably beep the alarm 19 at a preset time.

The drive controller 20 has a pointer selector 202 for selecting the pointer to be adjusted by operating one of the external operation members (the winding crown 5, the A button 6 and the B button 7) and a pointer position adjuster 203 for adjusting position of the selected pointer by some other operation, in order to adjust the respective time-indicating pointers 11 to 13 and 15 to 18.

The pointer electronic timepiece 1 has a switch controller 70 in order to operate the pointer selector 202 and the pointer position adjuster 203.

The switch controller 70 accepts operation of the external operation members (the winding crown 5, the A button 6 and the B button 7), which includes a winding crown position detector 701 for identifying draw-out position (zero-stage, first stage and second stage) of the winding-crown 5, a switch A detector 702 for detecting pushing operation of the A button 6 and a switch B detector 703 for detecting pushing operation of the B button 7. The switch controller 70 transmits a signal corresponding to external operating condition from the outside to conduct operation such as various adjustment.

Accordingly, by operating one of the external operation members (draw-out of the winding crown 5, for instance), the pointer (minute CG hand 16, one-fifth second CG hand 15, and pointers 17 and 18 indicating alarm time) to be adjusted is selected by the pointer selector 202 and, by operating the other external operation member (pushing of the A button, for instance), the selected pointer is adjusted by the pointer position adjuster 203.

At this time, in order to show which one of the pointers is to be operated, a selected object indicator 204 is provided to the drive controller 20. The selected object indicator 204 rotates, for instance, the selected pointer once to show the object being operated without special displaying means.

Further, the pointer selector 202 has a selection switch 206 for sequentially switching the selected pointer by the same operation in selecting the pointer to be adjusted.

Further, the pointer selector 202 has a standard selector 205 for selecting a predetermined specific object (the alarm pointer, for instance) at the initial selection in entering from an ordinary indication to the pointer adjustment.

Incidentally, the respective portions of the above-described drive controller 20 and the switch controller 70 may be arranged as a hardware having a below-described logic circuit as a main component. In this case, a part of the above-described respective portions and means may be doubled or shared by the other portions. On the other hand, a small computer system to be installed in device may be incorporated in the pointer electronic timepiece 1 to implement the above-described respective portions and means by software by executing a control program by the computer system, or a combination of the software arrangement and the above-described logic circuit may be used.

Next, specific drive control of the respective step motors may be described below with reference to control block diagram of FIGS. 3 and 4.

The drive controller 20 of the respective step motors has a crystal oscillator (OSC) 31 for outputting a time standard signal. The frequency of the oscillation signal from the crystal oscillator 31 is divided by a first frequency divider (DIV1) 32 and a second frequency divider (DIV2) 33 to become a 1 Hz signal, which is inputted in the drive pulse generator 21.

The drive pulse generator 21 outputs a drive pulse to the motor driver 25 in response to the inputted 1 Hz signal to drive the step motor M9. Accordingly, the small second hand 13 moves for one second (one pulse). The minute hand 12 and the hour hand 11 move interlocking with the movement of the small second hand 13.

Incidentally, the motor driver 25 also detects rotation of the step motor M9 and the information is fed back to the drive pulse generator 21. The drive pulse generator 21 re-generate the drive pulse to rotate the step motor M9 when the step motor M9 is not rotated. The function of the primary pointer drive controller 201 is achieved as described above.

The 1 Hz output signal of the second frequency divider 33 is also inputted to the logical regulator 34. The logical regulator 34 conducts digital regulation for stretching and contracting a time standard signal or a frequency divided signal (the output signal of the first divider 32 in the present embodiment) at a predetermined correction cycle (regulation cycle) for a necessary correction amount (regulation amount) in order to correct a shift of the time standard signal outputted by the oscillator 31 from an absolute time. In the present embodiment, the logical regulator 34 outputs signal to the first frequency divider 32 for every ten seconds.

The output of the first frequency divider 32 is inputted to a third frequency divider (DIV3) 35. The third frequency divider 35 outputs 5 Hz signal which is inputted to the one-fifth second CG hand drive controller 50.

As described below, the pulse signal for every one minute from the one-fifth second CG hand drive controller 50 is inputted to the minute CG hand drive controller 40.

The signal outputted for every ten seconds from the logical regulator 34 is also inputted to a minute alarm counter 36. The minute alarm counter 36 is a three-bit senary counter, which outputs the pulse signal each time six pulses of the signal for every ten seconds is inputted, i.e. for every one minute, to an alarm pointer drive controller 60.

Then, the pulse signals from the respective drive controllers 40, 50 and 60 are inputted to the drive pulse generators 22 to 24 to control the drive of the respective step motors. Further, signal is outputted from the alarm pointer drive controller 60 to an alarm sound generator 29, so that the alarm is generated by the alarm driver 30.

Figure 4:
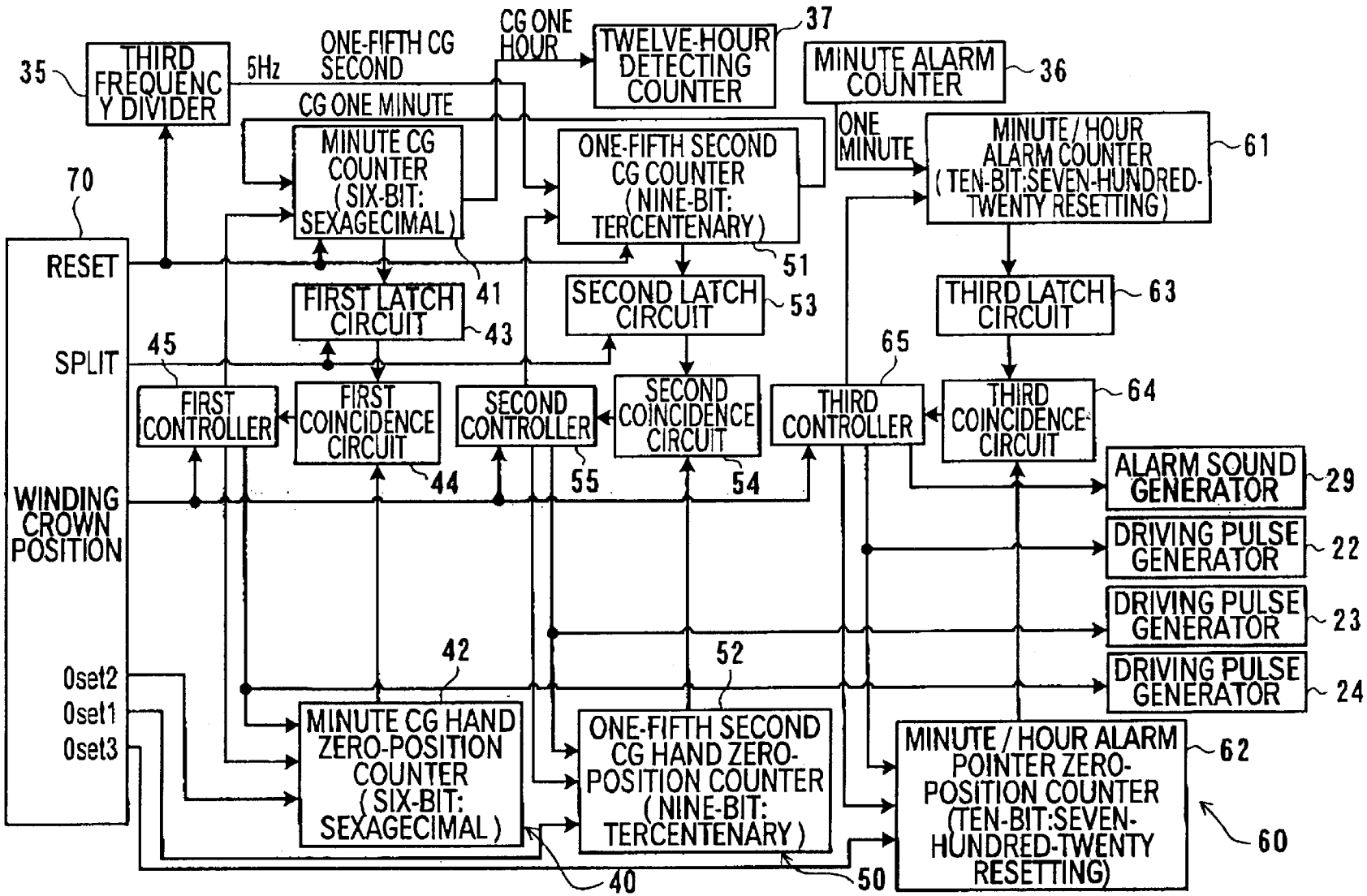
FIG. 4 is a block diagram showing a primary portion of a drive controller of the aforesaid embodiment.

As shown in detail in FIG. 4, the minute CG hand drive controller 40 has a minute CG counter 41, a minute CG hand position counter 42, a first latch circuit 43, a first coincidence circuit 44 and a first control circuit 45.

In the same manner, the one-fifth second CG hand drive controller 50 has a one-fifth second CG counter 51, one-fifth second CG hand zero-position counter 52, a second latch circuit 53, a second coincidence circuit 54 and a second control circuit 55.

Further, the alarm pointer drive controller 60 has a minute/hour alarm counter 61 as a current time counter, a minute/hour alarm hand zero-position counter 62 as an alarm counter, a third latch circuit 63, a third coincidence circuit 64 and a third control circuit 65. Incidentally, though the third latch circuit 63 is constantly in no-latch state and is unnecessary, the third latch circuit 63 is preserved for an arrangement having an hour CG hand instead of the alarm hands 17 and 18.

Figure 5:
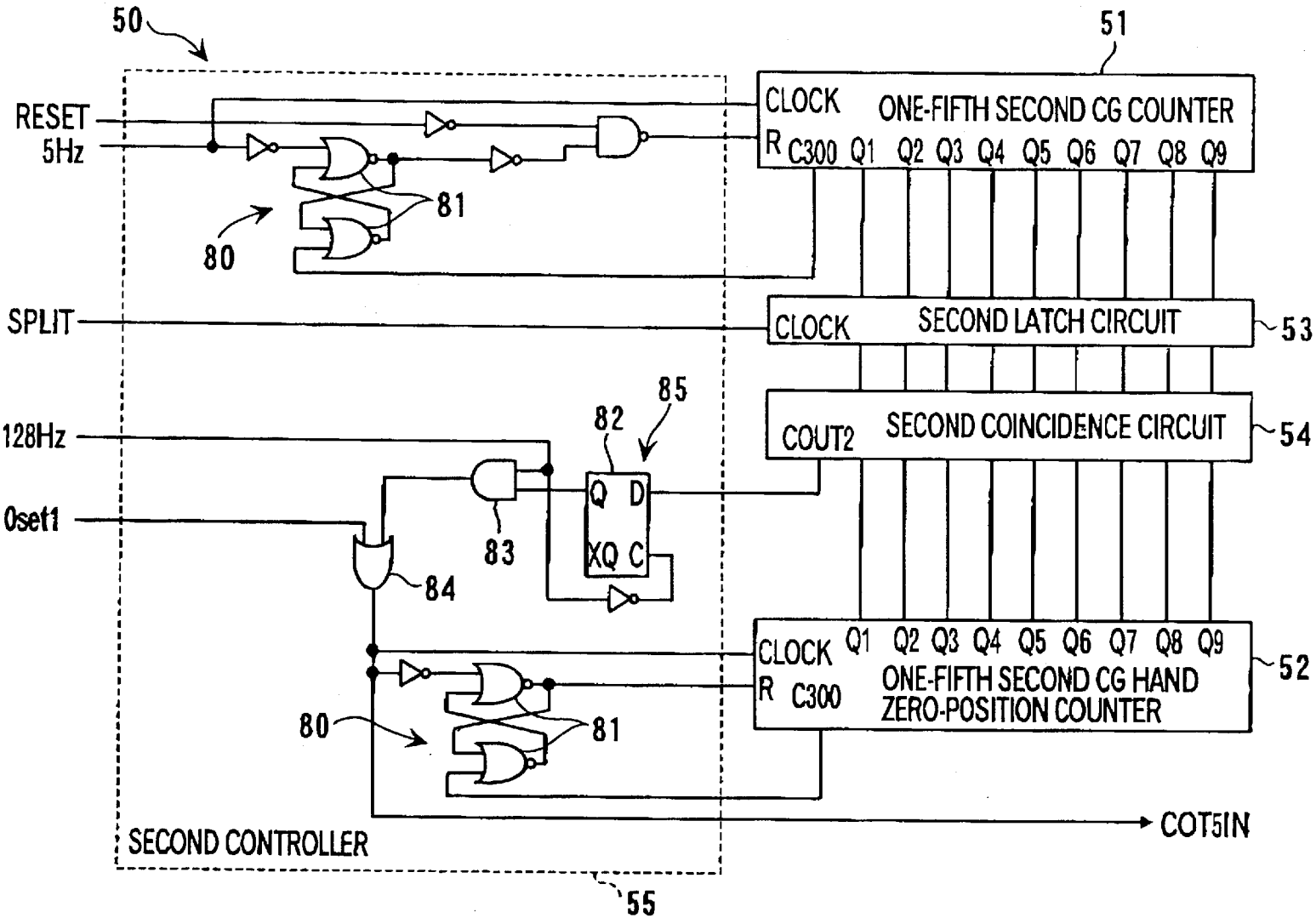
FIG. 5 is a block diagram showing an arrangement of one-fifth second CG hand drive controller of the aforesaid embodiment.

As shown in FIG. 5, the one-fifth second CG counter 51 is composed of nine-bit counter, which is arranged as tercentenary counter for resetting the counter by inputting a signal into a reset terminal R when the counter value becomes three hundred. Accordingly, each time three hundred pulses of 5 Hz signal are inputted to the clock input, i.e. one minute, can be counted. A predetermined pulse signal (CG one minute) is outputted to the minute CG counter 53 for every one minute. In the same manner, the one-fifth second CG hand zero-position counter 52 is arranged as nine-bit tercentenary counter.

The minute CG counter 41 is a six-bit sexagecimal counter. Accordingly, each time sixty pulses of pulse signals for every one minute is inputted, i.e. one hour, can be counted. A pulse signal is outputted from the minute CG counter 41 for every one hour, which is inputted to four-bit duodecimal twelve-hour detecting counter 37. When the twelve-hour detecting counter 37 detects that twelve hours has elapsed, in other words, when measured time of the stop watch (chronograph) reaches twelve hours, the measurement is automatically stopped and reset to return the respective one-fifth second CG hand 15 and the minute CG hand 16 to a reset condition.

The minute CG zero position counter 42 is six-bit sexagecimal counter similarly to the minute CG counter 41.

Figure 6:
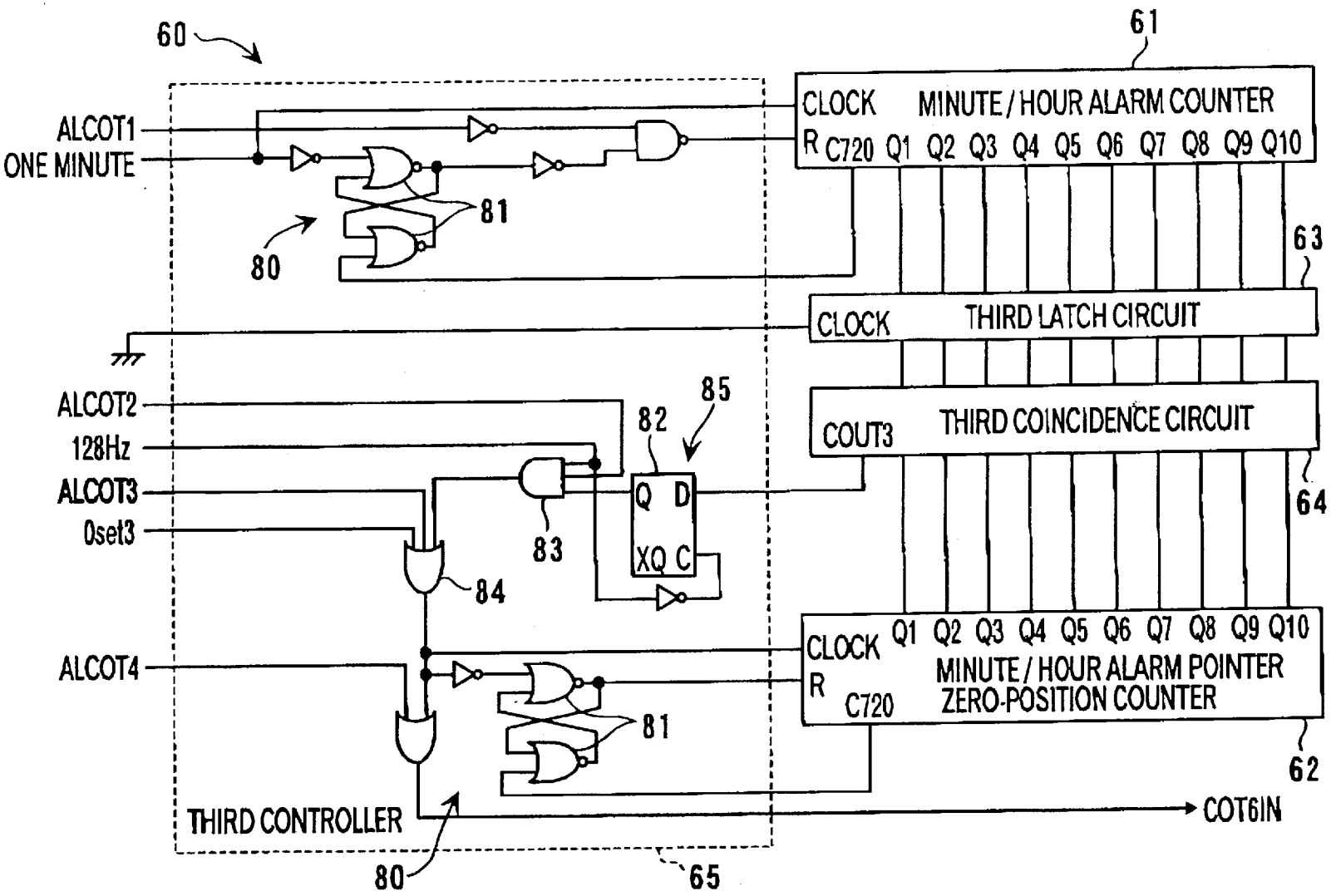
FIG. 6 is a block diagram showing an arrangement of alarm hand drive controller of the aforesaid embodiment.

As shown in FIG. 6, the minute/hour alarm counter 61 is composed of ten-bit counter, and is arranged as a seven-hundred-twenty resetting counter which is reset when the counter value becomes "720" by inputting a signal into the reset terminal R. Accordingly, seven-hundred twenty pulses of signals for every one minute inputted to the clock input, i.e. seven hundred twenty minutes (twelve hours), can be counted. Accordingly, the same time (current time) as the primary timepiece pointers 11 to 13 is counted to the minute/hour alarm counter 61 as the current time counter by the signal from the minute alarm counter 36.

Similarly, the minute/hour alarm hand zero-position counter 62 is a ten-bit seven-hundred-twenty resetting counter, which can store the alarm setting time within the range of twelve hours.

Respective controllers 45, 55 and 65 resets the respective counters 41, 42, 51, 52, 61 and 62 when the counters reaches a predetermined counter value and outputs a predetermined pulse signal (128 Hz of pulse signal, for instance) to the respective drive pulse generators 22 to 24 in response to the output of the respective coincidence circuits 44, 54 and 64, winding crown signal, and SWA and SWB signals.

For instance, as shown in FIG. 5, the controller 55 has a reset processor including a NOR gate 81 for resetting the respective counters 51 and 52, and a signal generator 85 including a flip-flop 82 and an AND gate 83 etc. for outputting a predetermined pulse signal to the drive pulse generator 23 in response to the output of the coincidence circuit 54 etc.

As shown in FIG. 6, the controller 65 has a reset processor including a NOR gate 81 for resetting the respective counters 61 and 62, and a signal generator 85 including a flip-flop 82 and an AND gate 83 etc. for outputting a predetermined pulse signal to the drive pulse generator 23 in response to the output of the coincidence circuit 64 etc.

The other controller 45 has the same arrangement.

The operation of the winding crown 5 and A button (SWA) 6 and B button (SWB) 7 is detected by the switch controller 70 as shown in FIG. 3. Reset signal, split signal, winding crown position signal and zero-set signal (0set 1 to 0set 3) are outputted in response to the position of the winding crown and the respective switch operation to implement respective functions as shown in FIG. 8.

The winding crown 5 can be pulled out to three stages of zero stage (RM0), first stage (RM1) and second stage (RM2), the draw-out position being detected by whether a switch RM1 and a switch RM2 are on or off. Specifically, when the winding crown 5 is at the zero stage, both of the switches RM1 and RM2 are off, at the first stage, only the switch RM1 is on and, at the second stage, only the switch RM2 is on.

When the A button 6 is pressed, the switch A (SWA) turns on. When the B button 7 is pressed, the switch B (SWB) turns on.

Figure 7:
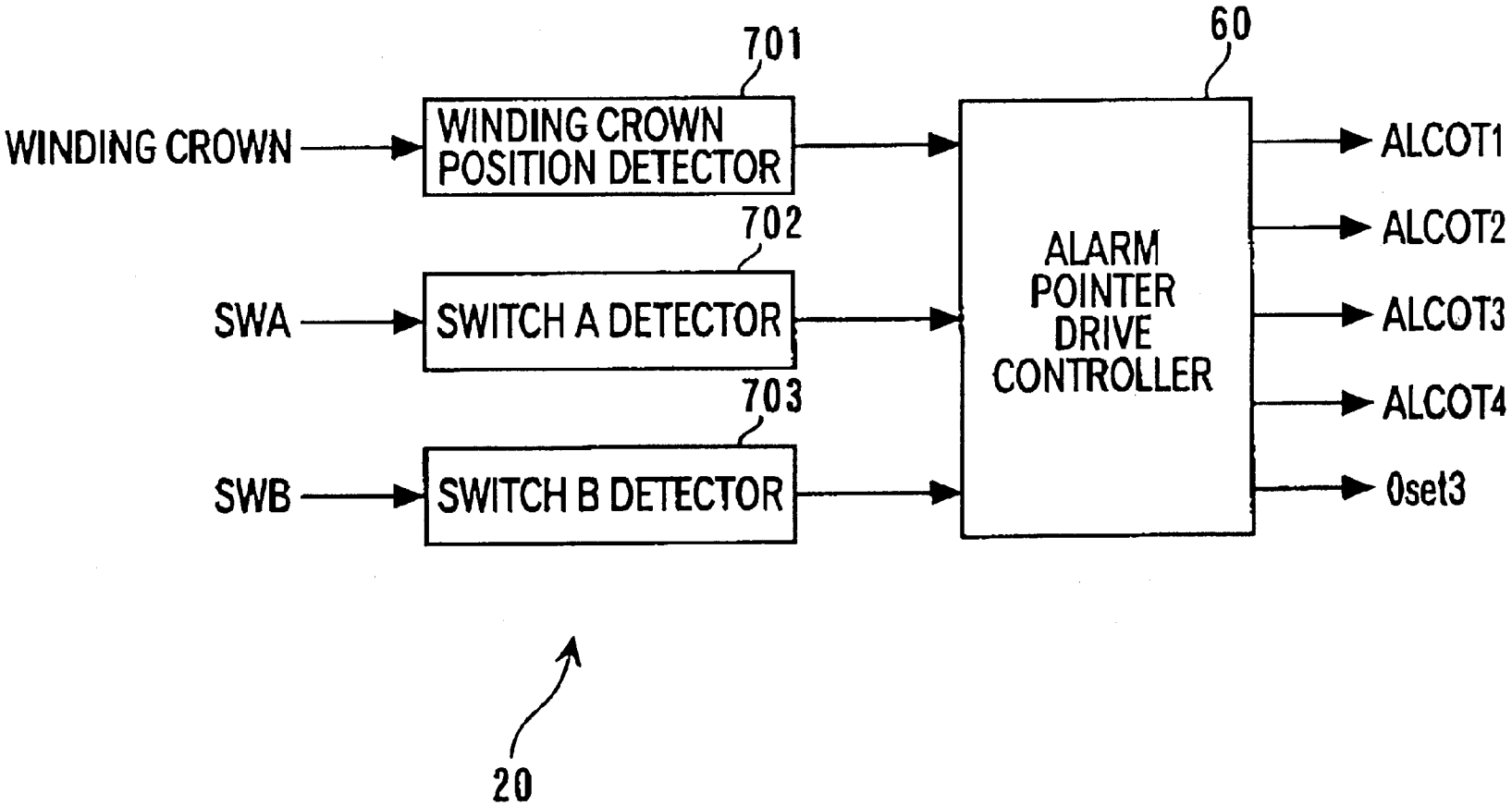
FIG. 7 is an illustration showing a function block of the alarm hand drive controller of the aforesaid embodiment.

Accordingly, as shown in FIG. 7, in the drive controller 20 as the alarm controlling means, the alarm pointer drive controller 60 as the alarm controller outputs operation control signals ALCOT1 to 4 and 0set 3 based on a operation information of the winding crown position detector 701, the switch A detector 702 and the switch B detector 703.

Incidentally, the ALCOT1 is a signal for resetting the minute/hour alarm counter 61 as the current time counter, which is specifically outputted to reset the counter 61 when the system is reset such as battery exchange of the pointer electronic timepiece 1.

The ALCOT2 is a signal for controlling whether rapid-feed pulse of 128 Hz is outputted from the signal generator 85, which becomes an H-level signal when the winding crown 5 is located at the second stage (alarm current time adjusting mode). Accordingly, at the alarm current time adjusting mode, the rapid-feed pulse of 128 Hz is outputted from the signal generator 85 to rapid-feed the alarm pointers 17 and 18 until the values of counters 61 and 62 coincide, and the alarm pointers 17 and 18 are halted when the values of the counters 61 and 62 coincide.

The ALCOT3 outputs H-level signal each time the B button 7 (switch B) is pressed when the winding crown 5 is at the first stage (alarm time setting mode). Accordingly, the minute/hour alarm hand zero-position counter 62 is counted up and the alarm pointer 18 is advanced for one minute. Incidentally, the alarm controller 69 outputs the ALCOT3 as a rapid-feed pulse of approximately 128 Hz when the B button 7 is continuously pressed, as described below.

The ALCOT4 outputs H-level signal each time the B button 7 (switch B) is pressed when the winding crown 5 is at the second stage (alarm current time adjusting mode). Accordingly, only the alarm pointers 17 and 18 can be advanced for one minute without changing the value of the minute/hour alarm hand zero-position counter 62, so that the lag between the pointers 17 and 18 can be adjusted when the current time of the alarm pointers 17 and 18 is adjusted.

As described below, the 0set 3 is outputted only by one pulse when the winding crown 5 is located at the second stage (alarm current time adjusting mode) and the A button 6 (switch A) is pressed to select the alarm current time adjusting mode.

Next, a function of the present embodiment will be described below with reference to timing chart of FIG. 9.

[1] Winding Crown Rotation Function

Rotation function of the winding crown 5 is the same as an ordinary timepiece. As shown in FIG. 8, the winding crown 5 rotates freely at the zero-stage, adjusts day by right rotation at the first stage, and adjusts pointers of primary timepiece, i.e. the hour hand 11, the minute hand 12 and the small second hand 13 at the second stage.

[2] Chronograph Function (Start and Stop of Chronograph)

When the winding crown 5 is at the zero-stage, the third frequency divider 35 and the respective counters 41 and 51 are in reset condition by a reset signal inputted from the switch controller 70. After pressing the A button 6 (SWA), the reset condition is released to start chronograph function.

Then, 5 Hz signal is inputted to the one-fifth CG second counter 51 from the third frequency divider 35 to increment the counter value of the counter 51 by one for every one-fifth second. When the counter value of the counter 51 is incremented by one, the non-latched second latch circuit 53 just passes the value of the counter 51. The second coincidence circuit 54 for comparing the value of the second latch circuit 53 and the value of the one-fifth second CG hand zero position counter 52 finds the value inconsistent, so that H-level signal is outputted from an output COUT2 thereof. The second control circuit 55 has the same component as the signal generator 85 of the third control circuit 65 and the H-level signal is inputted to flip-flop 82 of the signal generator 85 to modify an output Q of the flip-flop 82, thereby outputting 128 Hz of pulse signal through the AND gate 83 and the OR gate 84.

The pulse signal is inputted to a clock input of the counter 52 and is transmitted to the drive pulse generator 23. The counter value of the counter 52 is incremented by one by the inputted signal to coincide with the value of the second latch circuit 53, so that the output COUT2 becomes L-level signal and the output Q of the flip-flop 82 also becomes L-level, thereby suspending outputting the 128 Hz pulse signal. In other words, the 128 Hz pulse signal is outputted by one pulse, so that the drive pulse generator 23 inputted with the pulse signal moves the one-fifth second CG hand 15 by one pulse.

The above operation is repeated to move the one-fifth second CG hand 15 for every one-fifth second, resulting in one rotation by three hundred pulses, i.e. for one minute. Incidentally, the one-fifth second CG hand 15 moves for every one pulse by the angle of 360/300, i.e. by 1.2 degree.

In the minute CG hand drive controller 40, the pulse signal is inputted from the one-fifth second CG second counter 51 for every one minute to be inconsistent with the value of the counter 52, so that the minute CG hand 16 moves by one pulse in the same process as the one-fifth second CG hand drive controller 50. Incidentally, since the minute CG hand 16 conducts one rotation by inputting sixty pulses of CG one minute, i.e. an hour, the minute CG hand 16 moves by 360/60 degree, i.e. six degrees, for every one pulse.

After the A button 6 is pressed again, the chronograph stops.

(Split, Split Release)

After starting the chronograph, split condition is established by pressing the B button 7. In this condition, even when the respective second latch circuits 43 and 53 are in latch state, the output value thereof is maintained at the latch time. Accordingly, the values of the respective counters 42 and 52 stay consistent, so that the one-fifth second CG hand 15 and the minute CG hand 16 are suspended. However, since the pulse signal is continuously inputted into the respective counters 41 and 51, respective counter values are continuously incremented.

When the B button is pressed to release the split condition, there can be difference between the values of the counters 41 and 51, i.e. the latch circuits 43 and 53 and the counters 42 and 52 for the elapsed time during the latched condition. Accordingly, 128 Hz rapid-feed pulse is inputted to the counters 42 and 52 until the difference is eliminated. The rapid-feed pulse is also inputted to the drive pulse generators 23 and 24, and the one-fifth second CG hand 15 and the minute CG hand 16 are rapidly fed until the values of the counters 41 and 51 and the values of the counters 42 and 52 coincide to be moved to a position indicating an elapsed time commanded by the counters 41 and 51. Thereafter, ordinary chronograph function movement is conducted. Accordingly, split and release thereof are conducted.

(Chronograph Reset)

The chronograph is reset when the B button 7 is pressed while the chronograph is stopped. When the chronograph is reset, the counters 41 and 51 are reset to "0", and the hands 15 and 16 are rapidly fed by the 128 Hz rapid-feed pulse until the counter values of the counters 42 and 52 become "0" to return to zero position.

[3] One-Touch Alarm Function

One-touch alarm function is achieved by the alarm pointer drive controller 60 as the alarm control means. The alarm function will be described below with reference to flow charts shown in FIGS. 10 and 11.

(Ordinary Pointer Drive)

When no alarm is set and the winding crown 5 is at the zero-stage or at the first stage, the alarm pointers 17 and 18 are driven by the stationary pulse from the minute alarm counter 36 in one-minute cycle to indicate the current time as the primary timepiece pointers 11 and 12. The minute alarm counter 36 and the alarm pointer drive controller 60 achieve the function of an alarm pointer drive controller 601. Incidentally, when the winding crown 5 is at the second stage, the pointers 17 and 18 are stopped in the same manner as the pointers 11 and 12. Accordingly, when the winding crown 5 released from the second stage to the zero or the first stage, the pointer 18 is driven by a fixed pulse after one minute from releasing.

(Winding Crown Position Detection)

Figure 11:
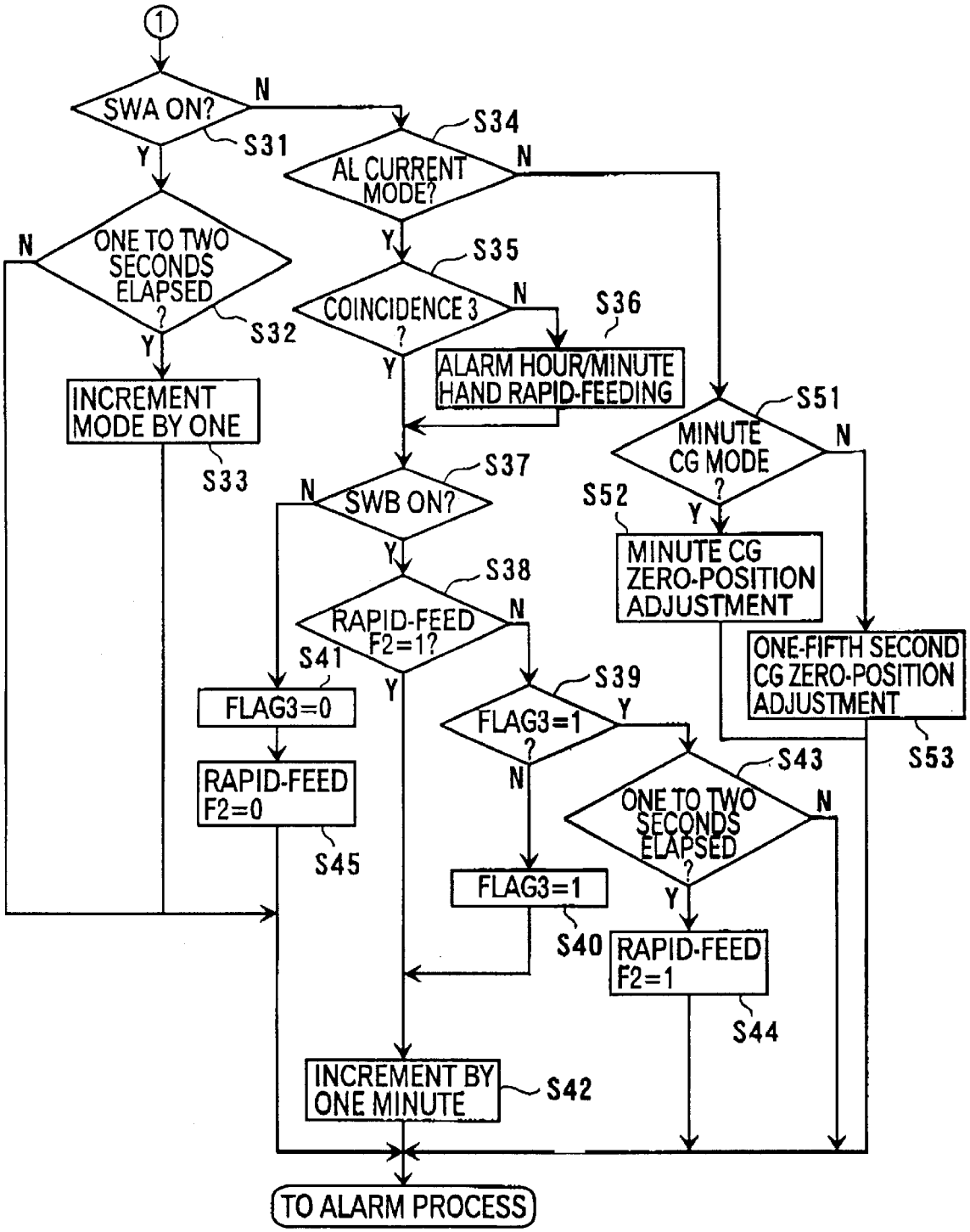
FIG. 11 is a flow chart showing a continuation of the flow chart shown in FIG. 10.

During alarm process, as shown in FIGS. 8 and 11, the position of the winding crown 5 is checked by the winding crown position detector 66. Specifically, whether the winding crown 5 is at the zero stage (RM0 is on) or not is checked (step 1: Respective steps will be abbreviated as 'S' hereinafter) and, when RM0 is off, whether the winding crown 5 is at the first stage (RM1 is on) or not is checked (S11). Incidentally, if RM1 is off at S11, in other words, both of RM0 and RM1 are off, the winding crown 5 is judged to be at the second stage.

(Alarm Beeping Mode)

When the winding crown 5 is at the zero stage (alarm beeping mode), whether flag 1 is 1 or not is checked (S2). The flag 1 is set when the alarm setting time is set during an alarm time setting mode (described below), which indicates "1" when the alarm is set. If the flag 1 is not "1", alarm process (winding crown position detection) will be resumed without any further process.

When the flag 1="1", whether the minute/hour alarm counter 61 coincides with the minute/hour alarm hand zero position counter 62 is checked (S3). In other words, when the ordinary pointer drive is established by pushing the winding crown 5 to the zero stage after setting the alarm setting time, the pulse signal is inputted to the counter 61 from the minute alarm counter 36 for every one minute, so that the counter value is changed corresponding to the current time. Even when the third coincidence circuit 64 is inconsistent, the pulse signal is not outputted from the third control circuit 65 to the drive pulse generator 22 and the counter 62 and the value of the counter 62 and the pointers 17 and 18 stay at the same condition (suspension).

When the value of the counter 61 coincides with the counter 62 and a coincidence signal is outputted from the third coincidence circuit 64 (S3), the flag 1 is set "0" to be returned to alarm non-set condition (S4) and a signal is transmitted to the alarm sound generator 29 to beep the alarm for a predetermined time, e.g. twenty seconds (S5).

Since the flag 1 is returned to 0, the alarm does not beep unless the alarm setting time is set again, thus achieving one-touch alarm function. Accordingly, by omitting S4 process, a daily alarm function for beeping the alarm when the alarm setting time and the current time coincide again after twelve hours can be achieved. The counters 61 and 62, the third coincidence circuit 64, and the third control circuit 65 achieve the function of an alarm executor 602.

(Alarm Beep Suspension)

Incidentally, when either the A button (SWA) 6 or the B button (SWB) 7 is pushed or the winding crown 5 is moved to the first stage or the second stage while the alarm is beeping, the beeping sound is stopped before elapsing twenty seconds.

(Alarm Time Setting Mode)

When RM1 is on (S11) and the winding crown 5 is at the first stage, the process switches to the alarm time setting mode. During the alarm time setting mode, whether the B button 7 is pressed, i.e. whether the SWB is on or not is initially detected by the switch B detector 703 (S12).

When SWB is on, whether "rapid-feed F1=1" or not is detected (S13). The "rapid-feed F1" is a flag for judging whether the alarm hour/minute hands 17 and 18 are rapidly fed, which is set as "rapid-feed F1=1", i.e. rapidly feeding, by continuously pressing the B button 7 for more than a predetermined time (one to two seconds, for instance) as described below.

When the rapid-feed F1 is not "1", whether "flag 2=1" or not is detected (S14). The "flag 2" is set as "1" when the B button 7 is initially pressed (S15), and when the B button 7 is not pressed, in other words, when the SWB is off in S12, returned to "0" (S16), so that the flag is used for judgment whether the B button 7 is continuously pressed or not. Accordingly, in S14, when the flag 2 is not "1", the flag 2 is set "1" in S15.

Subsequently, the alarm minute hand 18 is advanced for one minute (S 17), and is set as alarm-set condition (S18).

Then, whether the minute/hour alarm counter 61 and the minute/hour alarm hand zero-position counter 62 coincide or not is judged (S19). If the counters do not coincide, the process returns to the alarm process.

When the flag 2 is "1" in S14, i.e. when the B button 7 is continuously pressed, whether the B button 7 is continuously pressed or not for more than a predetermined time (e.g. one to two seconds) is detected (S20). When the B button 7 is pressed for more than the predetermined time, the rapid-feed F1 is set "1" to set rapid-feeding (S21).

The "rapid-feed F1" returns to "0" when the SWB is switched off in S12 (S22). Accordingly, when the B button 7 is continuously pressed, the rapid-feed F1 stays "1", so that "Y" branch is selected in S13 to repeat one-minute advancement of the minute hand 18 (S17), thereby rapidly feeding the alarm hour/minute hands 17 and 18.

When the values of the counters 61 and 62 coincide in S19, in other words, when the alarm hour/minute hands 17 and 18 coincide with the primary timepiece pointers 11 and 12, the flag 1 of the alarm set is reset to "0" to release alarm-set condition (S23), and the rapid-feed F1 is reset to "0" to terminate rapid-feed process (S24) thereby achieving a function of a rapid-feeder 604.

Accordingly, in the alarm time setting mode, each time the B button (SWB) 7 is pressed while the winding crown 5 is drawn out to the first stage (RM1 is on), the pulse signal ALCOT3 is inputted to the drive pulse generator 22 (inputted as signal COT6IN) and the minute/hour alarm hand zero-position counter 62, so that the values of the pointers 17 and 18 and the counter 62 change to establish alarm-time-set condition (flag 1=1). The alarm time is set by repetition of pressing the B button 7 until the pointers 17 and 18 move to the time when the alarm setting is desired.

When the B button 7 is continuously pressed while RM1 is on the pulse signal ALCOT3 is inputted as a rapid-feed pulse, thereby rapidly feeding the pointers 17 and 18. When the pointers 17 and 18 coincide with the current time, the rapid-feeding (pointer drive) is stopped (rapid-feed F1=0) and the alarm setting is canceled (flag 1=0). Further, when the B button 7 is pressed, the pointers 17 and 18 are again moved to continue alarm time setting.

Incidentally, when the winding crown 5 is at the first stage, the alarm is not beeped in spite of coincidence of the alarm setting time (the value of the counter 62) with the alarm current time (the value of the counter 61).

Further, though the pointers 17 and 18 are normally driven as the primary timepiece pointers 11 to 13 when the winding crown 5 is at the first stage, the pointers 17 and 18 stop normal drive when the B button (SWB) 7 is pressed to be the alarm time set (flag 1=1) and is moved by the 13 button (SWB) 7.

However, when the flag 1 becomes "1" and the alarm is no more set by coincidence of the alarm setting time with the alarm current time by advancement for every one minute by one-pushing of the B button (SWB) 7 and accelerated correction by continuous pressing, normal drive of the pointers are resumed.

(Canceling Alarm)

As partly described in the above, for canceling the alarm, the alarm ceased to be set when the alarm setting time and the alarm current time coincide with each other while the alarm is set, when the alarm beeps (including suspension of the beeping sound) and when the winding crown 5 is moved to the second stage, whereby achieving a function of an alarm switching means 603.

[4] Pointer Position Adjustment Function (Position Adjusting Mode)

The winding crown 5 is drawn out to the second stage to switch into a position adjustment mode.

Figure 10:
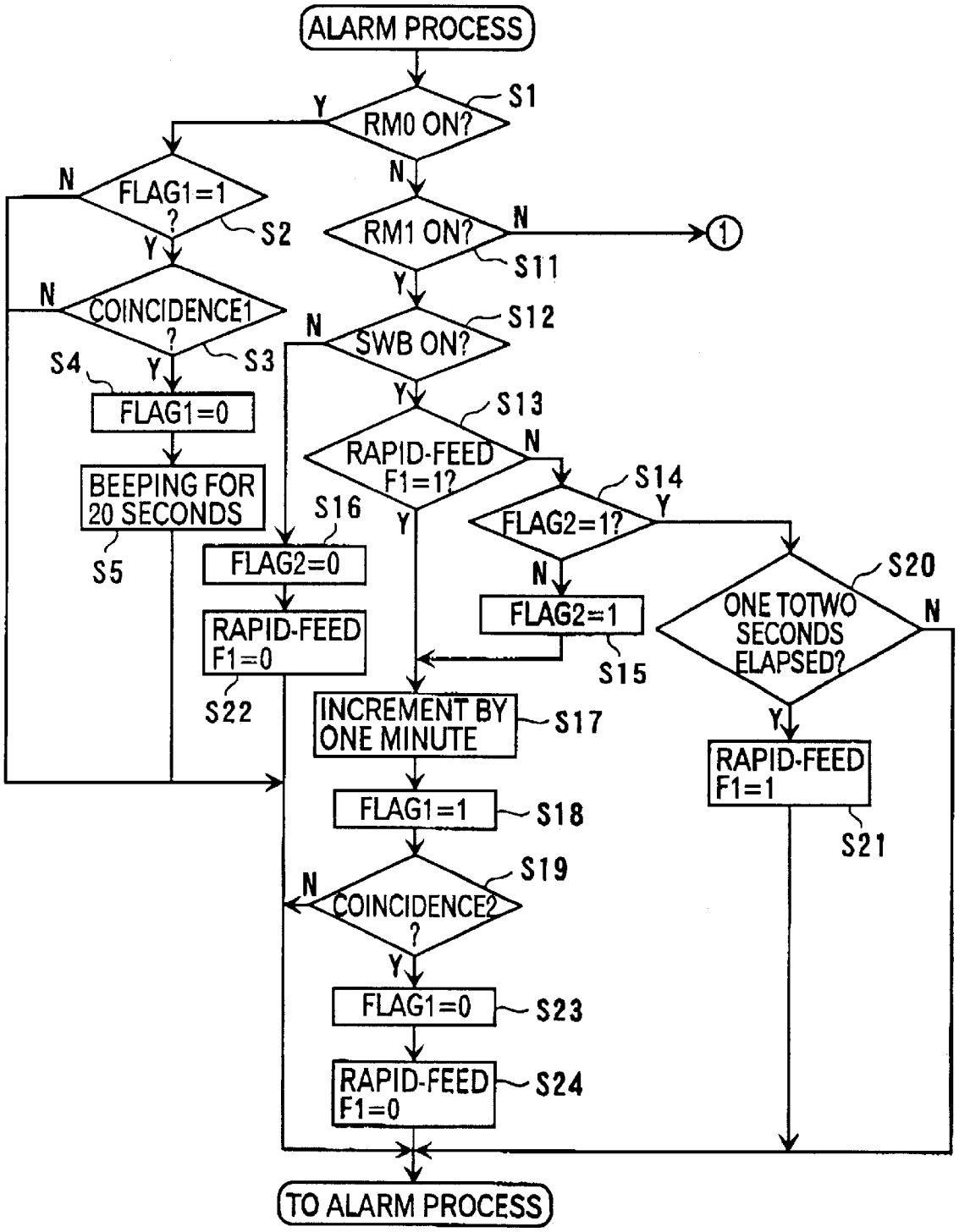
FIG. 10 is a flow chart showing a process of the alarm hand drive controller according to the aforesaid embodiment.

Specifically, when the winding crown 5 is drawn out to the second stage, branch of S11 in FIG. 10 is "N", so that the process in the position adjustment mode shown in FIG. 11 is conducted.

In the embodiment, three modes, i.e. alarm current time adjusting mode, minute CG zero-position adjustment mode and one-fifth second CG zero-position adjustment mode can be switched by pressing the A button 6.

When the process turns to the position adjustment mode in the present embodiment, the counters 41 and 51 are kept in reset condition, thus returning the pointers 15 and 16 to the zero-position as in the aforesaid chronograph resetting. Further, the alarm hour hand 17 and the minute hand 18 coincide with the current time as in the alarm current time coinciding process. Accordingly, a function of the pointer selector 202 can be achieved.

Figure 9:
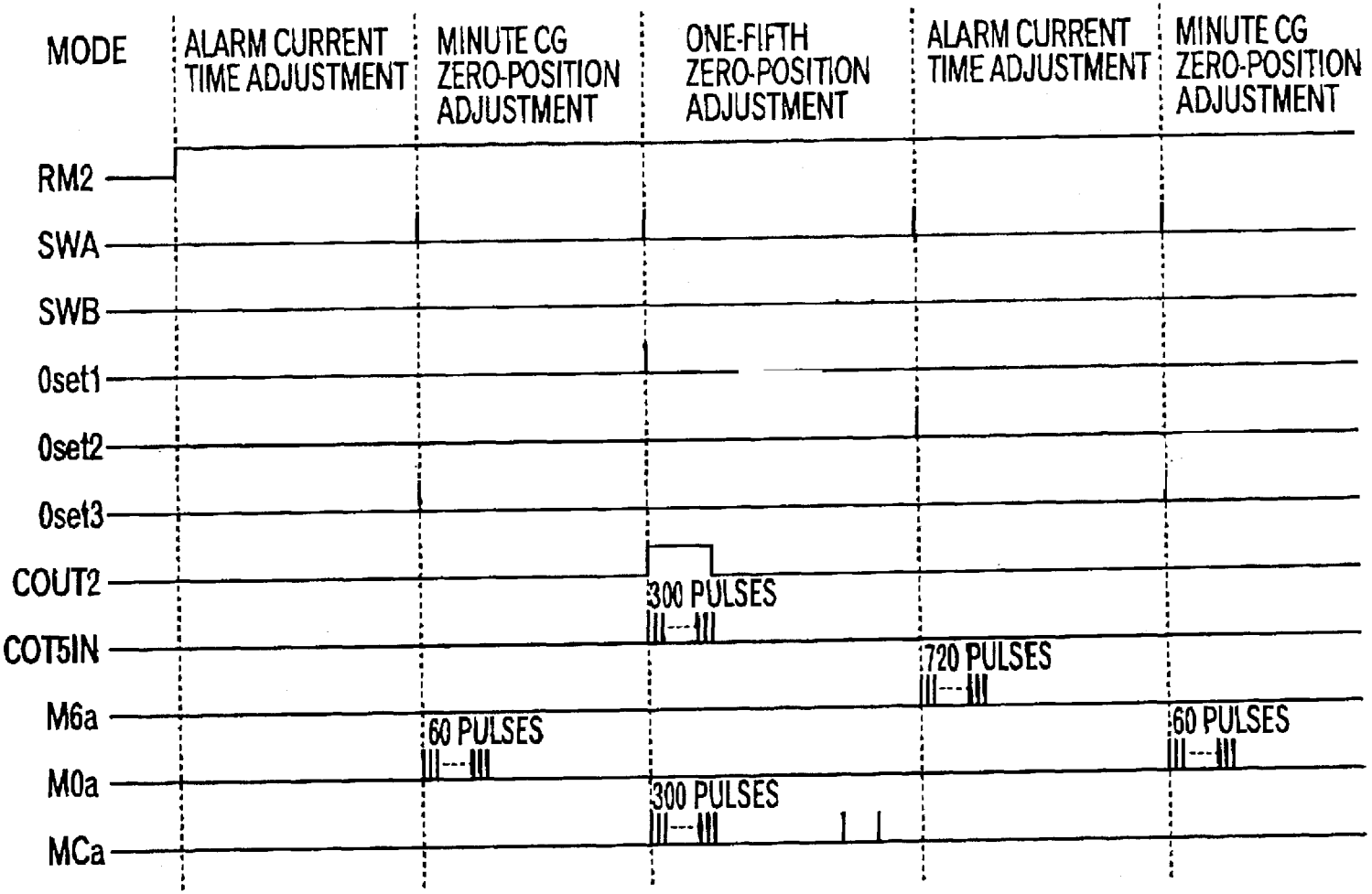
FIG. 9 is a timing chart showing a position adjusting operation of the pointer according to the aforesaid embodiment.

Further, as shown in FIG. 9, the alarm current time adjusting mode is automatically established at the initial stage. Accordingly, the function of the standard selector 205 is achieved. However, it is noted that the below-described one rotation of the selected pointer is not conducted in the initial first step.

(Alarm Current Time Adjusting Mode)

In the alarm current time adjusting mode, whether the A button 6 is pressed, i.e. whether SWA is on or not is initially detected (S31). When SWA is on, whether the A button 6 is pressed for more than a predetermined time (one to two seconds, for instance) is judged. When the A button is pressed for more than the predetermined time, in other words, when the operator explicitly presses the A button 6 to switch mode, mode change is conducted (S33). Specifically, when the winding crown 5 is drawn to the second stage, alarm current time adjusting mode is initially set. Subsequently, each time pressing the A button 6 for one to two seconds and releasing, three modes, i.e. the minute CG zero-position adjustment mode, one-fifth second CG zero-position adjustment mode and alarm current time adjusting mode, are alternatively switched.

On the other hand, when the branch of S31 is "N", whether the alarm current time adjusting mode (AL current mode) is established or not is judged (S34).

When the alarm current time adjusting mode is established, whether the values of the counter 61 and the counter 62 coincide with each other is checked (S35) and, when the values do not coincide (when the pointers 17 and 18 do not indicate the current time), the alarm hour/minute hands 17 and 18 are rapidly fed until the values of the counters 61 and 62 coincide (S36).

The setting of the alarm setting time is stored in the minute/hour alarm hand zero-position counter 62. In the present embodiment, the setting value is determined as a value relative to the minute/hour alarm counter 61 to which the current time data is stored. Accordingly, in order to set the alarm, the alarm hour hand 17 and the alarm minute hand 18 have to be brought into consistency with the current time. Therefore, in transiting to the alarm current time adjusting mode, the ALCOT2 becomes an H-level signal and, until the value of the counter 61 coincides with the value of the counter 62, a rapid-feed pulse is outputted corresponding to the difference between the counter values to drive the step motor M6.

When the values of the counter 61 and the counter 62 coincide, the output Q of the flip-flop 82 becomes an L-level signal, so that the output of the 128 Hz pulse signal is stopped and the pointers 17 and 18 are stopped. At this time, when pointer indication of the current time and the alarm current time are not the same, the alarm current time is adjusted to the current time by the B button 7. The operation of the B button 7 is the same as in the alarm time setting mode, where the signal ALCOT4 is outputted for every one pulse for each single pressing so that the alarm minute hand 18 is advanced by one minute without changing the value of the counter 62 and is rapidly fed by continuous pressing.

Specifically, whether the B button 7 (SWB) is on or not (S37) is judged, and, when the B button 7 is on, whether the "rapid-feed F2=1" or not is detected (S38). The "rapid-feed F2" is a flag for checking whether the alarm time/minute hands 17 and 18 are rapidly fed or not.

When the rapid-feed F2 is not "1", whether flag 3 is 1 or not is detected (S39). The "flag 3" is set "1" when the B button 7 is initially pressed in the alarm current time adjusting mode (S40), and is returned to "0" when the B button 7 is not pressed, i.e. when the B button 7 is off in S37 (S41). When the flag 3 is 1 in S40, the alarm minute hand 18 is advanced for one minute (S42) and alarm process is resumed.

When the "flag 3" is "1" in S39, in other words, when the B button 7 is continuously pressed, whether the B button 7 is continuously pressed for more than a predetermined time (e.g. one to two seconds) (S43). When the B button 7 is continuously pressed for more than the predetermined time, the "rapid-feed F2" is set "1" to set rapid-feeding (S44).

The "rapid-feed F2" is returned to "0" when the SWB is off in S37 (S45). Accordingly, when the B button 7 is continuously pressed, since the rapid-feed F2 stays "1", the branch in S38 is "Y", so that one-minute advancement of the minute hand 18 (S42) is repeated to rapidly feed the alarm hour/minute hands 17 and 18.

(Minute CG Zero Position Adjustment Mode, One-Fifth Second CG Zero Position Adjustment Mode)

On the other hand, when the branch in S34 is "N", whether minute CG zero-position adjustment mode is set or not is judged (S52), and conducts one-fifth second CG zero-position adjustment process if minute CG zero-position adjustment mode is not set (S53).

After transiting to the minute CG zero-position adjustment mode or the one-fifth CG zero-position adjustment mode, one shot of H-level signal (0set 2, 0set 1) is inputted to the clock input of the counters 42 and 52. Then, the values of the counters 42 and 52 having the same value as the counters 41 and 51, i.e. the latch circuits 43 and 53 are incremented by one to be inconsistent with the values of the latch circuits 43 and 53, so that rapid-feed is conducted until the values of the counters 42 and 52 coincide with the values of the latch circuits 43 and 53, i.e. until the minute CG hand 16 and the one-fifth second CG hand 15 rotates once.

Incidentally, when the mode is switched to the alarm current time adjusting mode (except for the first time immediately after the winding crown 5 is drawn out to the second stage), the alarm hour hand 17 and the alarm minute hand 18 (one rotation of time hand 17 and twelve rotations of minute hand 18 by seven hundred twenty pulses) are rapidly fed by inputting the output of 0set 3 to the counter 62.

Accordingly, the operator can easily recognize which one of the pointers 15 to 18 are selected.

As described above, after drawing out the winding crown 5 to the second stage to set the alarm current time adjusting mode, three modes of the minute CG zero-position adjustment mode, the one-fifth second CG zero-position adjustment mode, and the alarm current time adjusting mode are sequentially switched each time pressing for one to two seconds and releasing the A button 6, thus achieving the function of the selection switch 206.

(Indicating Selected Pointer)

Interlocking with the mode switching, when, for instance, the mode is switched to the one-fifth second CG zero-position adjustment mode, one shot. of H-level signal (0set 1) is inputted to the clock input of the counter 52. Then, the value of the counter 52 identical with the value of the counter 51, i.e. the latch circuit 53, is incremented by one to be inconsistent with the value of the latch circuit 53, so that the output COUT2 is changed to the H-level signal to output the 128 Hz rapid-feed pulse.

The rapid-feed pulse is inputted to the clock input of the counter 52 to add the value of the counter 52 and is outputted until the value coincides with the value of the latch circuit 53, i.e. for three hundred pulses including the first one shot, so that the one-fifth second CG hand 15 is rapidly fed by one rotation.

Similarly, when the mode is switched to the minute CG zero-position adjustment mode or the alarm current time adjusting mode (except for the first time immediately after the winding crown 5 is drawn out to the second stage), the output of 0set 3 or 0set 2 is inputted to the counters 42 and 62 for rapidly feeding the minute CG hand 16 (one rotation by sixty pulses), the alarm hour hand 17 and the alarm minute hand 18 (one rotation of the hour hand 17 and twelve rotations of minute hand 48 by seven hundred twenty pulses).

Accordingly, the operator can easily recognize which one of the pointers 15 to 18 are selected, thereby achieving the function of the selected object indicator 204.

(Position Adjusting Operation: Pointer Setting Operation)

When the B button 7 is pressed after the pointers 15 to 18 are selected, the pulse signal corresponding to the number of the button-pressing is inputted to the drive pulse generators 22 to 24 of the pointers 15 to 18 selected in the respective modes, so that the respective pointers can be moved to be corrected for every one pulse. Accordingly, position shift of the one-fifth second CG hand 15 and the minute CG hand 16 relative to the zero-position (ordinarily in twelve o'clock direction of a timepiece) can be corrected, and the position shift of the alarm hour hand 17 and minute hand 18 relative to the current time can be corrected, thereby achieving the function of the pointer position adjuster 203.

According to the present embodiment, following advantages can be obtained.

(1) Since the pointer to be corrected can be selected by the A button 6 as one of the external operation members and the position adjustment can be conducted by the B button 7 as the other one of the external operation members, even when the number of the pointers 15 to 18 (the number of the step motors) to be corrected exceeds three, the position adjustment of the pointers 15 to 18 can be conducted by the two buttons 6 and 7. Accordingly, even when the pointer (step motor) increases, there is no need for increasing the number of the external operation member, so that the size, thickness and cost of the movement-holder can be reduced.

(2) Since the A button 6 is used solely for switching the respective position adjustment mode, button operation can be easily grasped operability thereof can be improved.

Specifically, since the button 6 is arranged for selecting the pointer and the button 7 is arranged for position adjustment of the selected pointer, thus being designed for dedicated use, the user can easily understand the operation and operability can be improved.

(3) Since the number of the buttons 6 and 7 is not necessary to be increased and the space inside the movement-holder can be widened, various functions such as chronograph function, alarm function and sensor function such as altimeter can be installed by incorporating step motor, pointer, sensor etc. Accordingly, multi-function timepiece can be achieved without increasing size thereof.

(4) Since position adjustment of the pointer can be conducted when the winding crown 5 is drawn out to the second stage, there is no need for moving the winding crown 5 to the other drawing position for continuing the position adjustment, thereby improving operability thereof.

Further, when the winding crown 5 is set at the other draw-out position (zero stage or the first stage), the other function such as start and stop of chronograph and alarm setting can be assigned to the buttons 6 and 7, so that many function can be achieved without increasing the buttons 6 and 7.

Furthermore, since the pointer selection and pointer collection functions work only when the winding crown 5 is explicitly moved to the second stage, mistaken operation can be reduced, thereby improving operability of the timepiece for the user. Especially, since the second stage of the winding crown 5 is also arranged as a position for adjusting primary hands such as the hour hand 11, the minute hand 12 and the small second hand 13, the position adjustment of the pointers 11 to 13 and 15 to 18 can be conducted at the single draw-out position of the second stage of the winding crown 5, thereby facilitating memorization for the user. Accordingly, operability of less frequent operation such as pointer adjustment can be improved.

(5) Since the pointers 15 and 18 rotates once when the pointers 15 to 18 to be adjusted are selected, the selected pointer can be easily recognized and efficiency of the adjustment work can be enhanced.

Further, in order to conduct one rotation of the pointer, only one pulse signal is necessary to be inputted into the counters 42, 52 and 62, so that drive can be easily controlled and cost increase can be restrained.

(6) Since the alarm hour hand 17 and the alarm minute hand 18 are automatically selected only by drawing out the winding crown 5 to the second stage, the steps of selecting operation of the pointer can be reduced, thus improving operability during adjustment.

(7) Since the frequently adjusted alarm pointers 17 and 18 are initially selected for adjustment, efficiency of the adjusting operation can be improved.

(8) Since the respective control modes are switched by the winding crown 5 for operating the primary timepiece pointers 11 to 13, conventional second winding crown is not necessary, so that the number of the external operation member can be reduced in the pointer electronic timepiece 1 having the alarm pointers 17 and 18.

Accordingly, the size and thickness of the movement-holder can be reduced, enabling free design and reducing cost thereof. Further, since the winding crown having switching mechanism requires larger space than the other external operation member such as a switch, the size and thickness of the movement-holder can be more efficiently reduced by reducing the number of the winding crown than reducing switches.

Further, since there can be a space inside the movement-holder, various functions such as chronograph function, alarm function and sensor function such as altimeter can be installed by incorporating step motor, pointer, sensor etc. Accordingly, multi-function timepiece can be achieved without increasing size thereof.

(9) Since the alarm beeping mode is set at the zero stage of the winding crown 5, the alarm time setting mode is set at the first stage and the alarm current time adjusting mode is set at the second stage, frequently used alarm beeping mode and the alarm time setting mode can be easily switched, so that overall operability of alarm operation can be improved.

(10) Since the B button 7 is provided in addition to the winding crown 5 and the respective operation in the alarm control mode is conducted by pressing the B button 7, the user of the timepiece 1 can operate with clear distinction between the operation under respective alarm control modes and the operation of the primary timepiece etc., so that operability can be improved even when the winding crown 5 is also used both for operating the primary timepiece pointers 11 to 13 and for controlling alarm.

(11) Since the B button (SWB) 7 is commonly used for adjusting the one-fifth second CG hand 15 and the minute CG hand 16, increase in the number of external operation members can be restrained, thereby reducing size and thickness of a multi-function timepiece. Further, since the operation in pressing the B button 7 is common to respective modes in that the selected pointers 15 to 18 are fed, the operation can be easily understood for the operator and operability can be improved with fewer number of the external operation member.

Further, since the pointers 15 to 18 are rapidly fed by continuously pressing the B button 7 for more than a predetermined time, the operability can be improved and operation time can be reduced.

(12) Since the alarm pointers 17 and 18 are driven in consistency with the primary timepiece while the alarm is not set and the alarm pointers 17 and 18 are suspended at the alarm setting time when the alarm is set, whether the alarm is set or not can be easily recognized. Especially, since the alarm pointer indicates the same time as the primary timepiece when the alarm is not set, whether the alarm is set or not can be further easily recognized.

(13) Since the alarm is canceled by setting the flag 1 as 0 (S4) when the alarm is beeped, one-touch alarm function can be easily achieved.

Further, by omitting the S4, daily-alarm function can be easily achieved. Accordingly, switching use of one-touch alarm function and daily-alarm function can be easily set.

(14) Since the alarm is set when the alarm setting time and the current time do not coincide and the alarm is canceled when the alarm setting time and the current time coincide during alarm time setting mode, alarm setting and canceling can be conducted without operating the other switch, thereby restraining increase in the external operation member.

(15) Since rapid-feed is automatically suspended when the alarm setting time and the current time coincide only by rapid-feed operation of the alarm pointer to bring the alarm setting time and the current time into consistency in order to cancel the alarm setting, the alarm setting time and the current time can be easily brought into consistency and operability for canceling the alarm setting can be improved.

Incidentally, the scope of the present invention is not limited to the above embodiment but includes modifications and improvements as long as an object of the present invention can be achieved.

Figure 12:
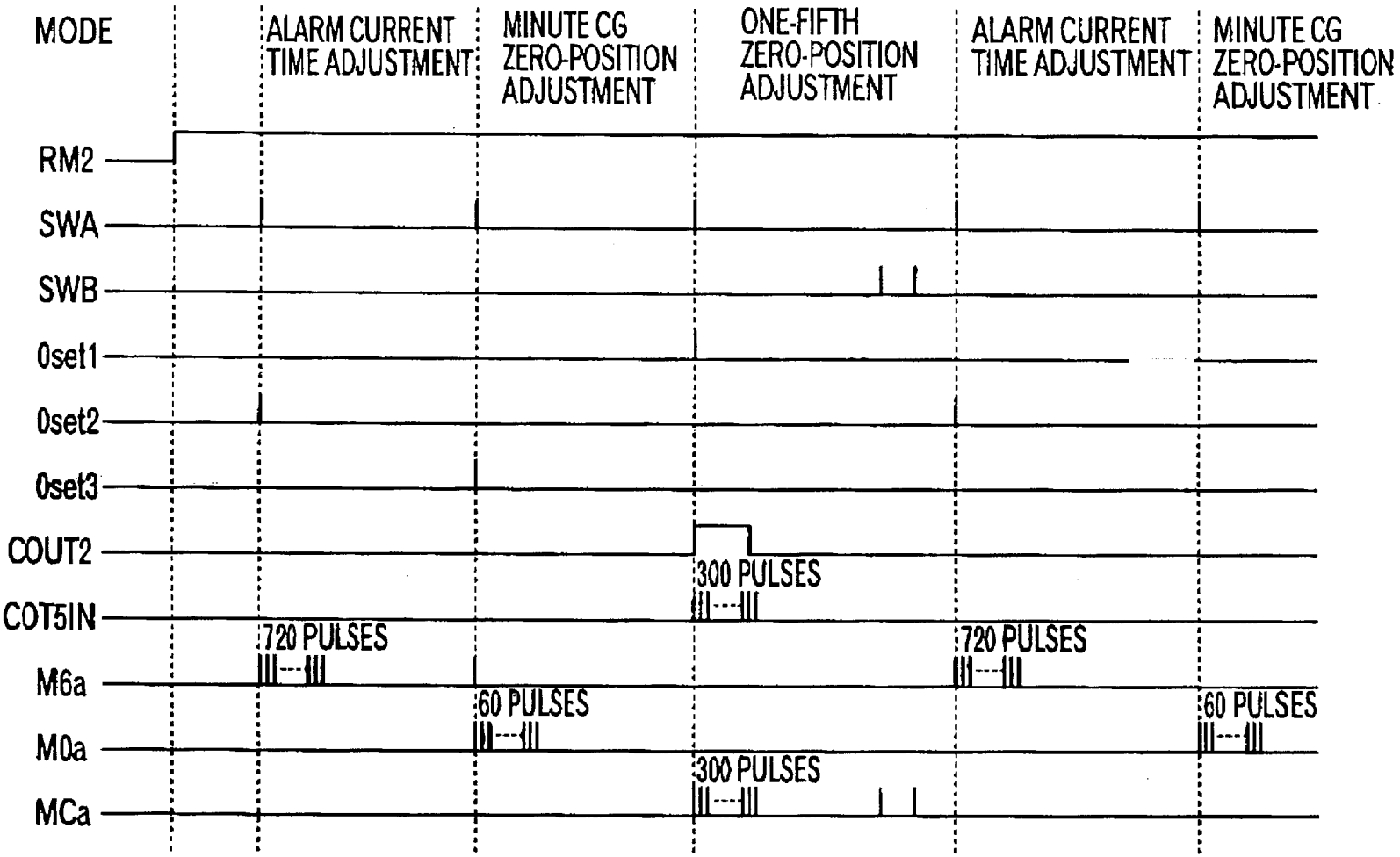
FIG. 12 is a timing chart showing a position-adjusting operation of a pointer according a modification of the present invention.

For instance, though the alarm hands 17 and 18 are selected only by drawing out the winding crown 5 to the second stage in the above embodiment, the pointer to be adjusted may be sequentially selected by pressing the button 6 after drawing out the winding crown 5 to the second stage as shown in timing chart of FIG. 12.

In this case, since the operation is common in that the position of the pointer selected by the button 7 is adjusted after selecting the pointer to be adjusted by the button 6, the user can easily understand the operation.

Though the alarm pointers 17 and 18 are initially selected in the above embodiment, one-fifth second CG hand 15 or the minute CG hand 16 may be initially selected.

Though the pointer is selected and position-adjusted at a single draw-out position such as drawing out the winding crown 5 to the second stage, the selection and position adjustment of the pointer may be conducted at more than one draw-out position of the winding crown 5. For instance, when there are a plurality of, for example, six pointers (step motors) to be adjusted, three pointers (step motors) may be adjusted at the winding crown's predetermined draw-out position and the residual three pointers (step motors) may be adjusted at the other draw-out position. In this case, as compared to selecting all the pointers at one draw-out position, button operation for selecting the pointer (step motor) to be adjusted can be reduced, thereby improving operability thereof.

Though the pointer electronic timepiece 1 incorporates chronograph function and alarm function, other functions such as world-time function and altimeter may further be incorporated or other function may be incorporated instead of chronograph function and alarm function, which may be designed in implementation as desired. For instance, as the sensor function indicating a value by a pointer, altimeter, bathometer, pressure gauge (water pressure etc.), sensor of power charged (remaining) by solar battery and button battery, and sensor of received radio field intensity of radio wave timepiece etc. may be selected and incorporated. Since the number of the external operation member such as the buttons 6 and 7 can be reduced in the present invention, many functions can be further incorporated thereby.

Further, though the pointer rotates once as a predetermined movement for recognizing the selected pointers 15 to 18 in the above embodiment, the pointer may be rotated more than once, or alternatively, the pointer may be kept rotating until the position adjustment is conducted by the button 7 or by selecting the other pointer by the button 6. Further alternatively, the pointer may be reciprocally moved at a predetermined angle without rotating the pointer. The movement may be determined in implementation as desired.

Though the alarm minute hand 18 is rotated twelve times for rotating the alarm hour hand 17 once, since the pointers 17 and 18 are interlocked, the alarm minute hand 18 may be rotated once. However, in this case, since the alarm hour hand 17 is shifted from the original position thereof, the alarm hour hand 17 may preferably be rotated once (twelve rotation for the alarm minute hand) as in the above embodiment.

The predetermined movement for identifying the selected object may not be provided when only two kinds of pointers (step motors) are provided. However, by providing the predetermined movement, the recognition of the selected object can be facilitated.

The external operation member is not limited to the push buttons 6 and 7, but may be a lever leaning in one direction or a dial of disk-shape. Specific structure and configuration of the external operation member may be arranged according to design of the timepiece as desired.

For instance, the alarm control mode is switched by the winding crown 5 and the B button is pressed to move the pointers 17 and 18 in the above embodiment. However, after switching the position of the winding crown 5, for instance, date and primary timepiece pointers 1 to 13 may be arranged to be operated by operating the winding crown 5 before a predetermined time elapses after switching the position of the winding crown 5, and the alarm hour/minute hands 17 and 18 may be set and position-adjusted by operating the winding crown 5 after the predetermined time elapses. However, operation with the B button 7 is easier to understand.

When the timepiece has only the alarm function, one switch may be provided as the external operation member other than the winding crown 5. In other words, though two switches 6 and 7 are required when mode-switching is required in the position adjustment mode in moving the winding crown 5 to the second stage, one switch may be provided when no mode switching is required.

Further, though the alarm hour/minute hands 17 and 18 are ordinarily driven when the alarm is not set in the above embodiment, the time of predetermined city or country may be indicated by the alarm hour/minute hands 17 and 18 by incorporating world-time function when the alarm is not set.

The relationship between the draw-out position of the winding crown and the three alarm control modes is not limited to the above embodiment. For instance, when the chronograph function is not installed, the zero stage may be assigned for the alarm time setting mode. However, considering operation mode of the primary timepiece pointers 11 to 13, the arrangement of the above embodiment is the most preferable.

The movement in the respective alarm control modes is not limited to those shown in the flow charts of FIGS. 10 and 11. For instance, though the alarm setting is canceled in the alarm time setting mode when the alarm setting time and the current time coincide, the alarm-set condition and alarm-non-set condition may be switched by operating the A button 6 etc. In short, the respective movements may be designed in accordance with the number of the external operation member etc. as desired.

The switch controller 70, the minute CG hand drive controller 40, the one-fifth second CG hand drive controller 50 and the alarm pointer drive controller 60 as main components for achieving the present invention are not restricted to the hardware arrangement such as various logical elements as shown in FIGS. 5 and 6, but may be a computer including CPU (central processing unit), memory (storage unit) etc. installed in the pointer electronic timepiece 1 to which a predetermined program is installed for achieving the above functions.

For instance, CPU and memory may be disposed in the pointer electronic timepiece 1 to function as a computer, where a control program of the present invention is installed therein through communication means such as the Internet and a storage medium such as CD-ROM and memory card. The installed program operates the CPU to achieve various functions such as the minute CG hand drive controller 40, the one-fifth second CG hand drive controller 50, the alarm pointer drive controller 60 and the switch controller 70.

In this case, in order to install the control program in the pointer electronic timepiece 1, the memory card or the CD-ROM may be directly plugged in the electronic device, or alternatively, a device for reading the storage medium may be externally connected to the electronic device. Further alternatively, the program may be distributed and installed by communication with the LAN cable and telephone line etc. to the electronic device or the control program may be distributed and installed to an internal receiver and memory by a wireless communication from the outside.

By installing the control program of the present invention provided as a storage medium or a communication means such as the Internet, the adjusting operation function can be provided with a software, so that function alteration can be facilitated. Further, function revision can be easily conducted to the commercially sold timepieces by replacing the program.

What is claimed is:

1. A pointer electronic timepiece, comprising:

a plurality of step motors;

a plurality of pointers driven by the step motors, the plurality of pointers at least including a primary timepiece pointer for indicating current time and an alarm pointer for indicating an alarm setting time;

a plurality of external operation members;

a current time counter for counting the current time;

an alarm counter for storing the alarm setting time;

an alarm beeper; and an alarm controller for controlling the alarm pointer and the alarm beeper;

wherein the external operation members include a winding crown for operating the primary timepiece pointer and at least one control switch in addition to the winding crown, said winding crown being capable of changing position thereof to at least three positions including a zero stage, a first stage and a second stage;

wherein the alarm controller switches among an alarm beeping mode, an alarm time setting mode, and an alarm current time adjusting mode in accordance with the three positions of the winding crown, said alarm beeping mode being effective for beeping an alarm when the current time coincides with the alarm setting time, said alarm time setting mode being effective for setting the alarm setting time, and said alarm current time adjusting mode being effective for adjusting the alarm pointer to the current time; and wherein when the alarm controller is switched to said modes in accordance with the position of the winding crown, the alarm controller is operated in the respective modes by said control switch as follows:

when the alarm controller is in the alarm beeping mode as determined from the position of the winding crown, the control switch is effective for stopping the beeping of the alarm;

when the alarm controller is in the alarm time setting mode as determined from the position of the winding crown, the control switch is effective for setting the alarm setting time; and when the alarm controller is in the alarm current time adjusting mode as determined from the position of the winding crown, the control switch is effective for adjusting the alarm pointer to the current time.

2. The pointer electronic timepiece according to claim 1, wherein the zero stage of the winding crown is also a position for ordinary driving, the first stage is also a position for date adjustment, and the second stage is also a position for pointer adjustment of the primary timepiece pointer; and wherein the alarm controller is set to the alarm beeping mode when the winding crown is positioned at the zero stage, is set to the alarm time setting mode when the winding crown is positioned at the first stage, and is set to the alarm current time adjusting mode when the winding crown is positioned at the second stage.

3. The pointer electronic timepiece according to claim 1, the alarm controller comprising:

a winding crown position detector for detecting the position of the winding crown;

a switch detector for detecting the condition of said control switch; and an alarm control portion for executing the operation in the respective modes based on a winding crown position information detected by the winding crown position detector and a switch condition information detected by the switch detector.

4. The pointer electronic timepiece according to claim 1, wherein the alarm controller includes an alarm pointer drive controller for controlling the alarm pointer so as to be stopped indicating the alarm setting time set in the alarm time setting mode, and so as to be driven to indicate the passage of time when no alarm setting time is set.

5. The pointer electronic timepiece according to claim 4, wherein the alarm pointer drive controller controls the drive of the alarm pointer to indicate the same time as the primary timepiece pointer when no alarm setting time is set.

6. The pointer electronic timepiece according to claim 1, wherein the alarm controller has an alarm executor for letting the alarm beeper beep an alarm and switch to an alarm-non-set condition when the alarm counter and the current time counter coincide in the alarm beeping mode; and wherein having the alarm setting time set defines an alarm-set condition.

7. The pointer electronic timepiece according to claim 1, wherein having the alarm setting time set defines an alarm-set condition and having the alarm setting time not set defines an alarm-non-set condition; and wherein the alarm controller has an alarm switch for setting the alarm-set condition in the alarm time setting mode when the alarm setting time and the current time do not coincide, and for setting the alarm-non-set condition in the alarm time setting mode when the alarm setting time and the current time coincide with each other.

8. The pointer electronic timepiece according to claim 7, wherein the alarm controller has a rapid-feeder for switching a feed motion of the alarm pointer to a rapid-feed motion by a predetermined operation, the rapid-feeder suspending the rapid-feed motion of the alarm pointer when in the alarm-time setting mode and when the alarm setting time and the current time coincide with each other while the alarm pointer was in rapid-feed motion.

9. The pointer electronic timepiece according to claim 1, further comprising:

a pointer selector for selecting the pointer to be adjusted from the plurality of pointers by operating any one of the external operation members among the external operation members; and a pointer position adjuster for adjusting a position of the selected pointer by operating another of said external operation members.

10. The pointer electronic timepiece according to claim 9, wherein the number of the step motor is more than the number of the external operation member.

11. The pointer electronic timepiece according to claim 9, wherein the pointer selector sets any one of the external operation members except for the winding crown in a selection mode for selecting the pointer to be adjusted hen the winding crown is drawn out to a predetermined first position, and wherein the pointer position adjuster sets another of said external operation members except for the winding crown in a position adjusting mode for adjusting the position of the selected pointer when the winding crown is drawn out to the predetermined first position.

12. The pointer electronic timepiece according to claim 11, wherein the predetermined first position for the winding crown to be drawn out is a position for adjusting a time of the primary timepiece pointer when the winding crown is rotated.

13. The pointer electronic timepiece according to claim 9, further comprising a selected object indicator for letting the selected pointer to be adjusted by operating the external operation member to conduct a predetermined movement to indicate the selected object.

14. The pointer electronic timepiece according to claim 13, wherein, as the predetermined movement of the selected pointer to be adjusted, the selected object indicator moves the selected pointer from the current position to return to the current position.

15. The pointer electronic timepiece according to claim 14, wherein, as the predetermined movement of the selected pointer to be adjusted, the selected object indicator rotates the pointer at least once.

16. The pointer electronic timepiece according to claim 15, further comprising:

a first counter for counting an input pulse of a predetermined time standard signal corresponding to the counters;

a second counter provided corresponding to the first counter;

a coincidence circuit for detecting whether the counter values coincide with each other or not; and a signal generator or outputting a pulse signal corresponding to a difference of the counter value to drive the step motor and for inputting the pulse signal to the second counter, the selected object indicator rotating the pointer at least once by inputting at least one pulse to the second counter when the pointers are selected.

17. The pointer electronic timepiece according to claim 9, the pointer selector comprising:

a standard selector for selecting a first pointer to be adjusted when the winding crown is drawn out to a predetermined position; and a selection switch for sequentially selecting the other pointer to be adjusted when any one of the external operation members except for the winding crown is operated while the winding crown is drawn out to the predetermined position.

18. The electronic timepiece according to claim 9, wherein the crown is capable of being drawn out to a plurality of predetermined positions, and wherein the pointer selector has a selection switch for sequentially selecting the other pointer to be adjusted when any one of the external operation members except for the winding crown is operated while the winding crown is drawn out to the predetermined position.

19. The pointer electronic timepiece according to claim 9, wherein the plurality of pointers includes an alarm pointer and a chronograph pointer, and wherein the pointer selector initially selects the alarm pointer in selecting the pointer to be adjusted from the pointers.

20. An operation method of a pointer electronic timepiece, the pointer electronic timepiece having a plurality of step motors; a plurality of pointers including at least a primary timepiece pointer for indicating a current time and an alarm pointer for indicating an alarm setting time, the plurality of pointers being driven by the step motors; a current time counter for counting the current time; an alarm counter for storing the alarm setting time; an alarm beeper; an alarm controller for controlling the alarm pointer and the alarm beeper; and a plurality of external operation members, said method comprising the steps of:

providing as one of said plurality of external operation members, a winding crown capable of operating the primary timepiece pointer, and said winding crown being capable of changing its position to at least three positions including a zero stage, a first stage and a second stage;

providing at leas one control switch in addition to the winding crown as another of said plurality of external operation members;

switching among an alarm beeping mode, an alarm time setting mode, and an alarm current time adjusting mode in accordance with the three positions of the winding crown;

when in the alarm beeping mode, issuing an alarm when the alarm setting time is set and the current time coincides with the alarm setting time;

when in the alarm time setting mode, setting the alarm setting time indicating when an alarm should be issued;

when in the alarm current time adjusting mode, adjusting the alarm pointer to the current time;

wherein when in the alarm beeping mode, as determined from the position of the winding crown, further responding to the control switch to stop the issuing of the alarm;

wherein when in the alarm time setting mode, as determined from the position of the winding crown, further responding to the control switch to set the alarm setting time; and wherein when in the alarm current time adjusting mode, as determined from the position of the winding crown, further responding to the control switch to adjust the alarm pointer to the current time.

21. The operation method of the pointer electronic timepiece according to alarm 20, wherein the alarm pointer is stopped while indicating the alarm setting time set in the alarm time setting mode, and wherein the alarm pointer is driven to indicate the passage of time when no alarm setting time is set.

22. The operation method of the pointer electronic timepiece according to claim 20, wherein having the alarm setting time set defines an alarm-set condition and having the alarm setting time not set defines an alarm-non-set condition, and wherein, when the alarm counter and the current time counter coincide while in the alarm beeping mode and in the alarm-set condition, the alarm beeper issues the alarm and the alarm-non-set condition is set.

23. The operation method of the pointer electronic timepiece according to claim 20, wherein an alarm-set condition is set while in the alarm time setting mode when the alarm setting time and the current time do not coincide, and wherein an alarm-non-set condition is set while in the alarm time setting mode when the alarm setting time and the current time coincide with each other.

24. The operation method of the pointer electronic timepiece according to claim 23, wherein a feeding motion of the alarm pointer is switched to a rapid-feeding motion by predetermined operation, and wherein the rapid feeding motion of the alarm pointer is stopped when the alarm setting time and the current time coincide in the alarm time setting mode and the alarm pointer was in rapid-feed motion.

25. The operation method of the pointer electronic timepiece according to claim 20, wherein the pointer to be adjusted is selected from the plurality of pointers by operating an one of the external operation members, and wherein the posit on of the selected pointer is adjusted by operating another one of the external operation members.

26. The operation method of pointer electronic timepiece according to claim 25, wherein the pointer to be adjusted is selected by any one of the external operation members except for the winding crown when the winding crown is drawn out to a predetermined first position, and the position of the selected pointer is adjusted by operating the other one of the external operation members except for the winding crown.

27. The operation method according to claim 25, wherein a predetermined movement is conducted by the pointer to be adjusted selected by operating the external operation member to indicate the selected object.

28. A control program installed in a pointer electronic timepiece, the pointer electronic timepiece having a plurality of step motors; plurality of pointers at least including a primary timepiece pointer for indicating a current time and an alarm pointer for indicating an alarm setting time, the plurality of pointers being driven by the step motors; a current time counter for counting the current time; an alarm counter for storing the alarm setting time; an alarm beeper; an alarm controller for controlling the alarm pointer and the alarm beeper; and a plurality of external operation members including a winding crown capable of operating the primary timepiece pointer and at least one control switch in addition to the winding crown, said winding crown being capable of changing its position to at least three positions of a zero stage, a first stage and a second stage, said control program comprising:

a step for switching the alarm controller among an alarm beeping mode, an alarm time setting mode, and an alarm current time adjusting mode in accordance with the three positions of the winding crown;

said alarm beeping mode being effective for beeping an alarm when the alarm setting time is set and the current time coincides with the alarm setting time, said alarm time setting mode being effective for setting the alarm setting time, and said alarm current time adjusting mode being for adjusting the alarm pointer to the current time wherein when the alarm controller is switched to said modes in accordance with the position of the winding crown, the alarm controller is responsive to said control switch in the respective modes, as follows:

when the alarm controller is in the alarm beeping mode as determined from the position of the winding crown, the alarm controller is made to respond to the control switch by stopping the beeping of the alarm;

when the alarm controller is in the alarm time setting mode as determined from the position of the winding crown, the alarm controller is made to respond to the control switch by setting the alarm setting time; and when the alarm controller is in the alarm current time adjusting mode as determined from the position of the winding crown, the alarm controller is made to respond to the control switch by adjusting the alarm pointer to the current time.

29. The control program installed in the pointer electronic timepiece according to claim 28, further executing a step of suspending the alarm pointer while indicating the alarm setting time set in the alarm time setting mode, and a step of driving the alarm pointer to indicate the passage of time when no alarm setting time is set.

30. The control program installed in the pointer electronic timepiece according to claim 28, wherein, when in the alarm beep mode and the alarm setting time is set, and when the alarm counter and the current time counter coincide, a step of letting the alarm beeper issue the alarm is executed and the alarm controller is switched to an alarm-non-set condition.

31. The control program installed to the pointer electronic timepiece according to claim 28, wherein having the alarm setting time set define an alarm-set condition and having the alarm setting time not set defines an alarm-non-set condition:

said control program further executing a steps of setting the alarm-set condition in the alarm time setting mode when the alarm setting time and the current time do not coincide, and setting the alarm-non-set condition in the alarm time setting mode when the alarm setting time and the current time coincide.

32. The control program installed in the pointer electronic timepiece according to claim 31, further executing a steps of switching a feeding motion of the alarm pointer to a rapid-feeding motion by a predetermined operation, and stopping the rapid feeding-motion of the alarm pointer when the alarm setting time and the current time coincide while the alarm pointer was in rapid-feed motion in the alarm time setting mode.

33. The control program installed to a pointer electronic timepiece according to claim 28, further executing the steps of selecting the pointer to be adjust d from the plurality of pointers by operating any one of the external operation members, and adjusting the position of the selected pointer by operating the other one of the external operation members.

34. The control program installed to a pointer electronic timepiece according to claim 33, further executing the steps of selecting the pointer to be adjusted by any one of the external operation members except for the winding crown when the winding crown is drawn out to a predetermined first position, and adjusting the position of the selected pointer by operating the other one of the external operation members when the winding crown is drawn out to the predetermined first position.

35. The control program installed to a pointer electronic timepiece according to claim 33, further executing the step of conducting a predetermined movement by the pointer to be adjusted selected by operating the external operation member to indicate the selected object.

* * * * *

UNITED STATES PATENT AND TRADEMARK OFFICE

CERTIFICATE OF CORRECTION

PATENT NO. : 6,639,874 B2
DATED : October 28, 2003
INVENTOR(S) : Eisaku Shimizu et al.

It is certified that error appears in the above-identified patent and that said Letters Patent is hereby corrected as shown below:

Column 30,
Line 26, change “the electronic timepiece” to -- the pointer electronic timepiece --;
Line 27, change “wherein the crown” to -- wherein the winding crown --; and
Line 58, change “leas” to -- least --.

Column 31,
Line 53, change “an” to -- any --; and
Line 55, change “posit” to -- position --.

Signed and Sealed this

Eighteenth Day of May, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,639,874 B2
DATED : October 28, 2003
INVENTOR(S) : Eisaku Shimizu et al.

It is certified that error appears in the above-identified patent and that said Letters Patent is hereby corrected as shown below:

Column 31,
Line 55, change "position on" to -- position --

Signed and Sealed this

Third Day of August, 2004

JON W. DUDAS
*Acting Director of the United States Patent and Trademark Office*